US006761322B1

(12) United States Patent
Porrill et al.

(10) Patent No.: US 6,761,322 B1
(45) Date of Patent: Jul. 13, 2004

(54) RAILWAY BASEPLATE ASSEMBLY

(75) Inventors: John Phillip Porrill, Godalming (GB); Stephen John Cox, Richmond (GB)

(73) Assignee: Pandrol Limited, Addlestone (GB)

( * ) Notice: Subject to any disclaimer, the term of this patent is extended or adjusted under 35 U.S.C. 154(b) by 0 days.

(21) Appl. No.: 10/130,892

(22) PCT Filed: Nov. 21, 2000

(86) PCT No.: PCT/GB00/04422

§ 371 (c)(1),
(2), (4) Date: May 23, 2002

(87) PCT Pub. No.: WO01/38642

PCT Pub. Date: May 31, 2001

(30) Foreign Application Priority Data

Nov. 24, 1999 (GB) ..... 9927786
Apr. 18, 2000 (GB) ..... 0009595

(51) Int. Cl.[7] ..... E01B 9/38
(52) U.S. Cl. ..... 238/264
(58) Field of Search ..... 238/109, 264, 238/265, 280, 283, 287, 292, 297, 310, 312, 315, 338, 129

(56) References Cited

U.S. PATENT DOCUMENTS

| | | | | |
|---|---|---|---|---|
| 4,134,546 A | * | 1/1979 | Dankert | 238/370 |
| 4,461,422 A | | 7/1984 | Harkus | 238/366 |
| 4,715,533 A | | 12/1987 | Bucksbee et al. | 238/283 |
| 4,756,477 A | | 7/1988 | Schumaker | 238/315 |
| 4,844,338 A | * | 7/1989 | Bucksbee | 238/283 |
| 5,096,118 A | * | 3/1992 | Matlock | 238/298 |
| 5,782,406 A | | 7/1998 | Igwemezie | 238/67 |

FOREIGN PATENT DOCUMENTS

| | | |
|---|---|---|
| EP | 0066995 | 12/1982 |
| EP | 0619852 | 6/1993 |
| EP | 0619851 | 10/1994 |
| FR | 423341 | 2/1911 |
| GB | 838860 | 6/1960 |
| GB | 1227182 | 4/1971 |
| GB | 1510224 | 5/1978 |
| GB | 2022657 | 12/1979 |
| GB | 2092211 | 8/1982 |

* cited by examiner

*Primary Examiner*—S. Joseph Morano
*Assistant Examiner*—Robert J. McCarry, Jr.
(74) *Attorney, Agent, or Firm*—Gottlieb Rackman & Reisman, P.C.

(57) ABSTRACT

A railway baseplate assembly comprising a baseplate (30), a cushioning pad (20) for lying beneath the baseplate (30), and means (10) for securing the baseplate (30) to an underlying rail foundation when the assembly is in use, wherein the said securing means (10) comprise a non-screw-threaded post member (12), which post member (12) extends, when in use, through holes (21, 31) provided in the baseplate (30) and cushioning pad (20) in such a way as to engage the said baseplate (30). The post member (12) and baseplate (30) may be such that engagement of the baseplate (30) with the post member (12) can be brought about by movement of the baseplate (30) relative to the post member (12) firstly in a direction substantially perpendicular to the plane of the baseplate (30) and towards the post member (12) so that the post member (12) extends through the hole (31) in the baseplate (30) and secondly in a direction substantially parallel to the plane of the baseplate so that the post member (12) engages the baseplate (30). The post member (12) is fastened, directly or indirectly, to the rail foundation and the post member (12), cushioning pad (20) and baseplate (30) may be such that the cushioning pad (20) and baseplate (30) can be brought into engagement with the post member (12) while the post member (12) is fastened to the rail foundation.

28 Claims, 31 Drawing Sheets

RAILWAY BASEPLATE ASSEMBLY

The present invention relates to a railway baseplate assembly suitable for use, for example, in attenuating vibrations.

Prior art rail fastening assemblies have been developed by the applicant which incorporate rail fastening clips of the type which are described in GB-1510224 (termed "e"-clips by the applicant) or of the type which are described in EP-B-0619852 (termed by the applicant FASTCLIP™ rail fastening clips).

A prior art rail fastening assembly of the latter type comprises, as shown in FIG. 1 of the accompanying drawings, a first, lower baseplate 1 which has an approximately rectangular shape and is formed at each of its four corners with an ear IC through which there is a hole 1A for receiving a bolt 1B by which the baseplate 1 is secured to an underlying railway foundation (not shown). On the approximately rectangular area defined between the bolts 1B on the upper surface of the baseplate 1 there is placed a cushioning pad 2 and on top of that pad 2 a second, upper baseplate 3 of approximately the same size and shape as the pad 2. The upper baseplate 3 is secured to the lower baseplate 1 through the use of screw-threaded bolts 3B which pass through openings 3A (not shown) in two diagonal corners of the upper baseplate 3, through corresponding openings 2A (not shown) in the underlying cushioning pad 2 and thence into the lower baseplate 1. The openings 3A in the upper baseplate 3 for receiving the bolts 3B are lined with respective rectangular bushes 4 (not shown). The upper baseplate 3 is formed, in its two diagonal corners which do not have openings 3A for the bolts 3B, with respective shoulders 5 for receiving respective rail clips 7 of the type described in EP-B-0619852. Such rail clips 7 are installed in the shoulders 5 to secure a rail 9 laid across a rail pad 8 provided on the upper baseplate 3 between the shoulders 5. Sidepost insulators 60 are provided on respective shoulders 5 to insulate the rail 9 from the shoulders 5.

The use of screw-threaded fastenings in a working part of the assembly, i.e. to hold the upper baseplate 3 to the lower baseplate 1, is undesirable owing to maintenance difficulties.

Furthermore, baseplates of this type are undesirably large because of the combined area occupied by the means by which the upper and lower baseplates are secured together and that occupied by the shoulders for receiving the rail fastening clips. The baseplate is particularly large where FASTCLIP™ rail fastening clips are used, because of the relatively large size of the shoulders required for this fastening. However, it is advantageous to use a FASTCLIP™ rail fastening clip because the clip can be retained by the shoulder in a pre-assembly position in which the clip is partially installed in the shoulder so as to retain the sidepost insulator and therewith the rail pad, thereby allowing the whole assembly to be delivered to site as a unit and hence speeding up the installation and maintenance of rail track. In addition, the FASTCLIP™ rail fastening clip may be more readily installed by machine, again speeding up the installation process.

According to an embodiment of a first aspect of the present invention there is provided a railway baseplate assembly for supporting a railway rail, which assembly comprises a baseplate, a cushioning pad for lying beneath the baseplate, and means for securing the baseplate to an underlying rail foundation when the assembly is in use, wherein the said securing means comprise a non-screw-threaded post member which extends, when in use, through holes provided in the baseplate and cushioning pad in such a way as to engage the said baseplate but not the said rail.

Preferably the post member and baseplate are such that engagement of the baseplate with the post member can be brought about by movement of the baseplate relative to the post member firstly in a direction substantially perpendicular to the plane of the baseplate and towards the post member so that the post member extends through the hole in the baseplate and secondly in a direction substantially parallel to the plane of the baseplate so that the post member engages the baseplate.

Desirably, the post member is fastened, directly or indirectly, to the rail foundation and the said post member, cushioning pad and baseplate are such that the cushioning pad and baseplate can be brought into engagement with the post member while the post member is fastened to the rail foundation.

Preferably there are two post members, which extend through respective holes in the baseplate and cushioning pad.

Desirably, two shoulders are provided on an upper surface of the said baseplate, for retaining respective rail fastening clips, the said holes in the said baseplate being located adjacent to respective shoulders such that the clips at least partially overlie said holes when installed in said shoulders. The said shoulders are desirably formed integrally with the said baseplate.

The or each post member is preferably provided with a laterally-extending tab which engages with a corresponding ledge in the baseplate.

In one embodiment, the or each post member may extend into an associated post housing provided in the said rail foundation. The or each said post member and the or each said post housing may be provided with interlocking serrations, whereby the height of the post member within the post housing can be adjusted. The said post member may be retained at a desired height within the post housing by means of a wedge member inserted between the post member and the post housing. A shim may be placed between the baseplate and the underlying rail foundation to support the baseplate at a desired height above the foundation.

In an alternative embodiment, the assembly further comprises a lower baseplate, located beneath the other baseplate, from which lower baseplate the said post member projects upwardly, said lower baseplate being attached to an underlying rail foundation when the assembly is in use. Desirably, the or each post member is formed integrally with the lower baseplate.

In another alternative embodiment, the or each post member is directly secured to the rail foundation.

The or each post member is preferably at least partially surrounded by a cushioning bush provided within the associated hole in the baseplate.

In embodiments of the present invention, respective covers are preferably provided over the holes in the baseplate. Means may be provided for locking the covers onto the baseplate.

The assembly may be used with rail fastening clips which are approximately M-shaped in plan, the shoulders preferably having walls for retaining outer legs of the rail fastening clips. In this case each cover may be provided with a ramp for use in deflecting the said rail fastening clip. Such an assembly may further comprise a sidepost insulator, clip toe insulator and rail pad. The sidepost insulator may have means for securing the insulator to the baseplate and a portion for preventing unintentional disengagement of the cover from the baseplate.

A baseplate for use in such an assembly as the said lower baseplate preferably comprises a plate-like member on which at least one post member is provided. The or each post member may be formed integrally with the plate-like member.

The or each post member preferably has a laterally-extending tab. In the case of two post members, the tab of one post member extends inwardly (i.e. towards the centre of the baseplate) and the tab of the other post member extends outwardly (i.e. away from the centre of the baseplate).

The or each post member is preferably hollow and substantially rectangular in outline.

A cushioning pad for use in an assembly embodying the present invention has one or more holes formed therein for receiving respective post members.

A baseplate for use in an assembly embodying the present invention comprises a plate-like member having one or more holes therein for receiving respective post members.

Such a baseplate preferably has two holes and further comprises shoulders on the said plate-like member which extend upwardly from a region of the said plate-like member around the said holes such that when a rail clip is installed in such a shoulder it at least partially overlies the said hole. Desirably, the said shoulders are formed integrally with the said plate-like member and are suitable for retaining substantially M-shaped rail clips.

A post member for use in one assembly embodying the present invention is shaped so as fit inside an associated post housing, the said post member having means for engaging the said associated post housing.

The post housing engaging means of such a post member preferably comprise serrations, provided on an exterior portion of the said post member, for engaging corresponding serrations on an interior portion of the said associated post housing. Desirably, the post member is hollow and has a tapered internal surface so as to accommodate a wedge member for urging the serrations of the post member against the serrations of the post housing.

A post housing for use in one assembly embodying the present invention is shaped so as to accommodate an associated post member, the said post housing having means for engaging the said associated post member. The post member engaging means of such a post housing preferably comprise serrations, provided on an interior portion of the said post housing, for engaging corresponding serrations on an exterior portion of the said associated post member.

A concrete railway sleeper for use with a railway baseplate assembly embodying the present invention is provided with two pairs of post housings.

Reference will now be made, by way of example, to the accompanying drawings, in which.

Figure 1:
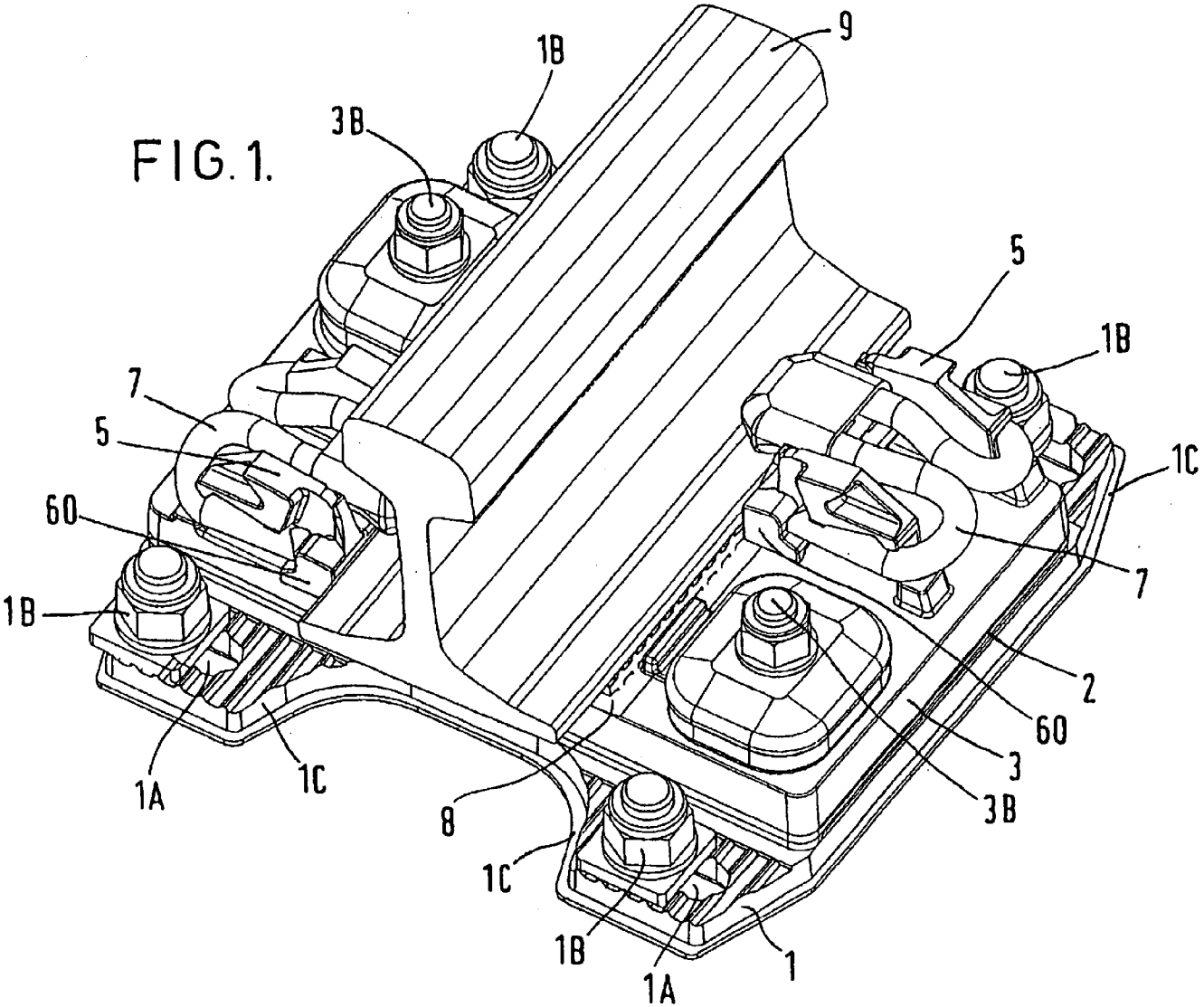
FIG. 1 (described above) shows a prior art rail fastening assembly.
Figure 2:
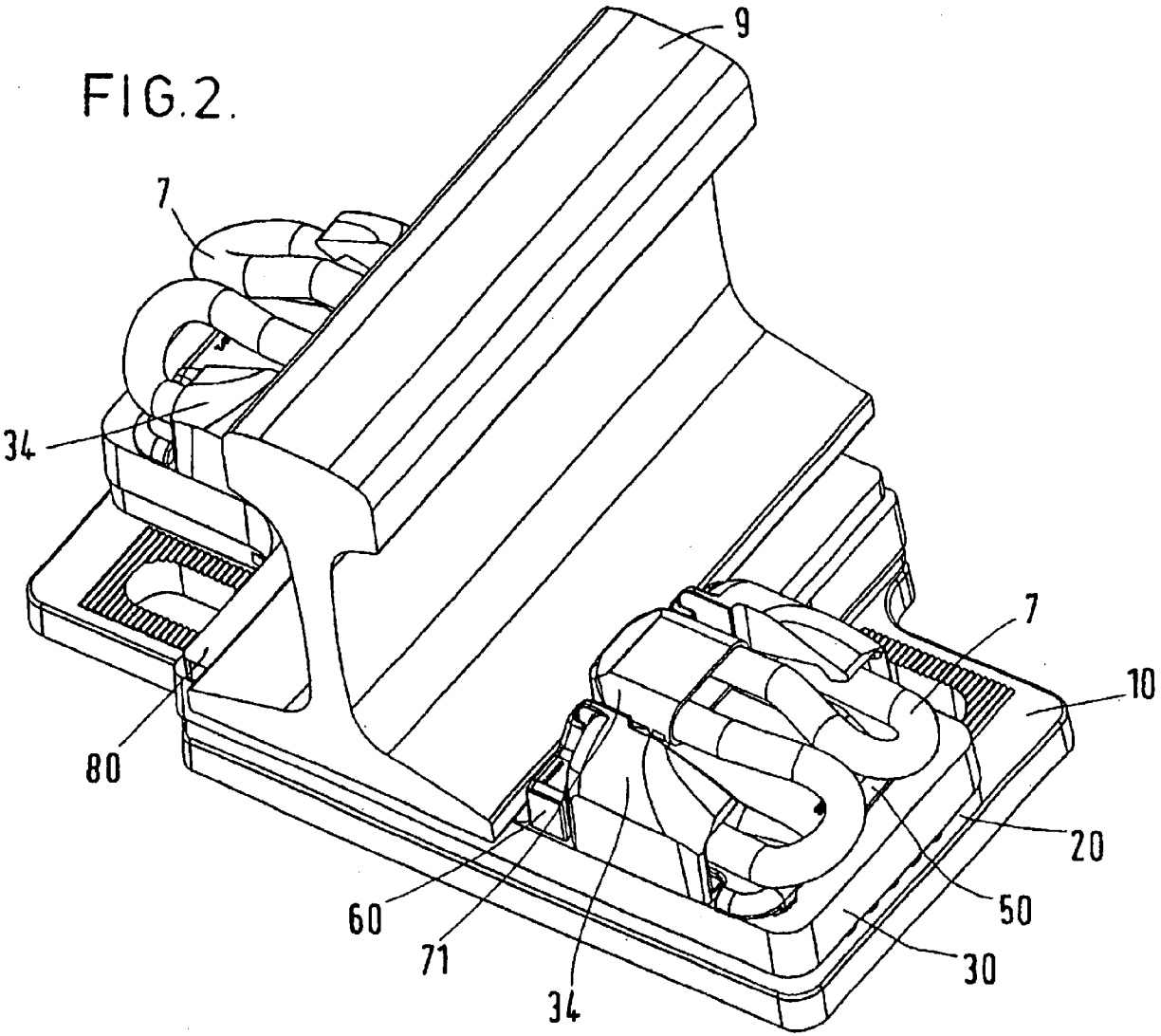
FIG. 2 shows a first rail fastening assembly embodying the present invention and a rail.

FIG. 2 shows a first rail fastening assembly embodying the present invention and a rail 9. In this embodiment, the assembly comprises a lower baseplate 10, a cushioning pad 20 placed thereover, an upper baseplate 30 placed over the cushioning pad 20, a pair of cushioning bushes 40.(not visible in FIG. 2), a pair of covers 50 over the bushes 40 and secured to the upper baseplate 30, a pair of sidepost insulators 60 secured to the upper baseplate 30, a pair of rail fastening clips 7 carrying respective toe insulators 71 and secured to the upper baseplate 30, and a rail pad 80 secured to the upper baseplate 30.

Figure 3:
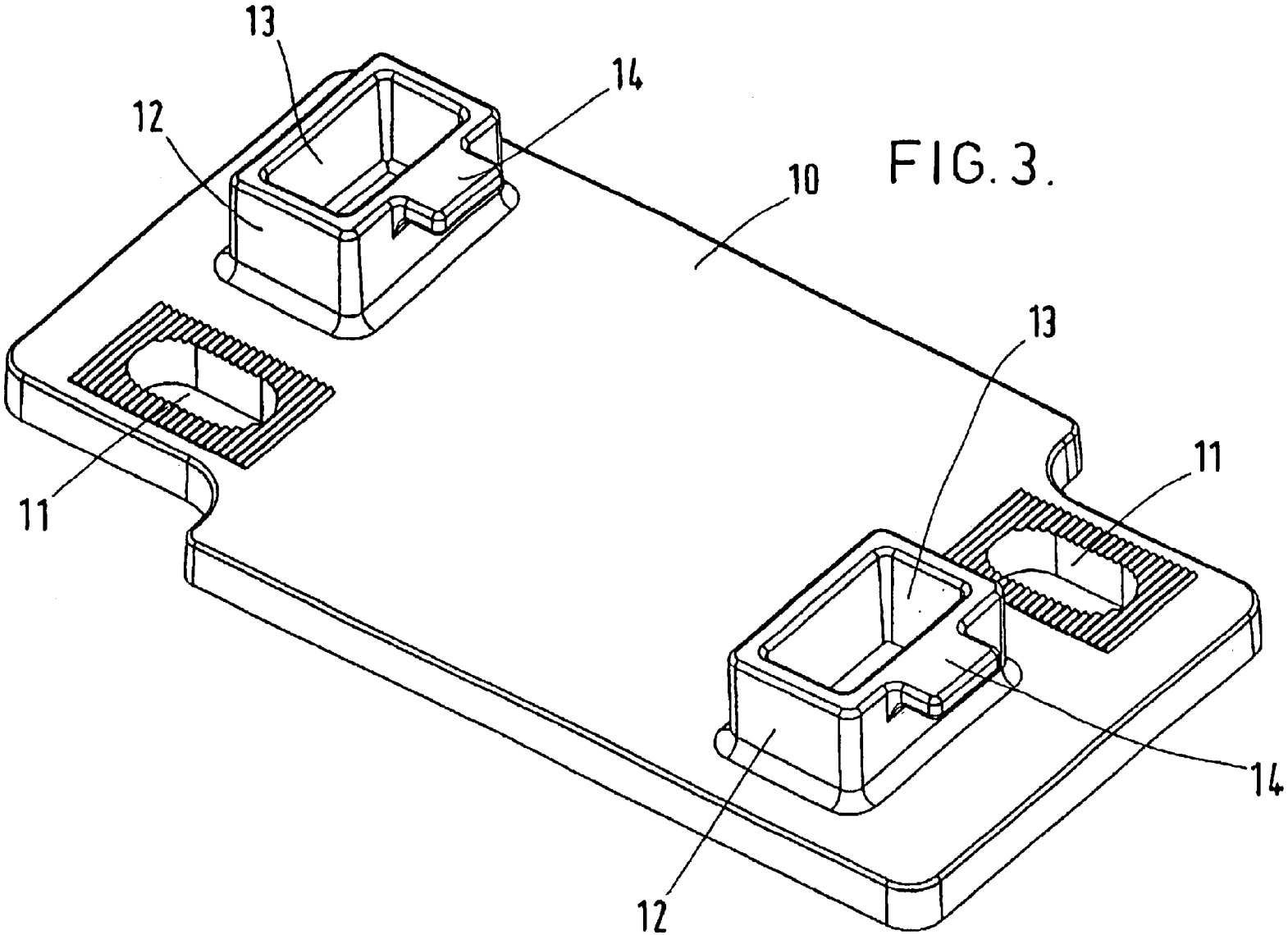
FIG. 3 shows a first part of the first rail fastening assembly embodying the present invention.

The lower baseplate 10 is shown in more detail in FIG. 3. The lower baseplate 10 comprises a substantially rectangular plate-like member and has at two diagonally-opposing corners respective elongate slots 11 for receiving means (not shown) whereby the lower baseplate 10 is secured to an underlying railway foundation. Protruding from corner regions of the baseplate 10 not having slots 11 are respective substantially rectangular hollow post members 12, called "studs" hereafter, having respective recesses 13 therein. The studs 12 are preferably formed integrally with the plate-like member of the lower baseplate 10. Projecting laterally from a wall of each stud 12 is a tab 14. The tab on one of the studs 12 projects inwardly towards the centre of the lower baseplate 10, whilst the tab 14 on the other of the studs 12 projects outwardly away from the centre of the baseplate 10.

Figure 4:
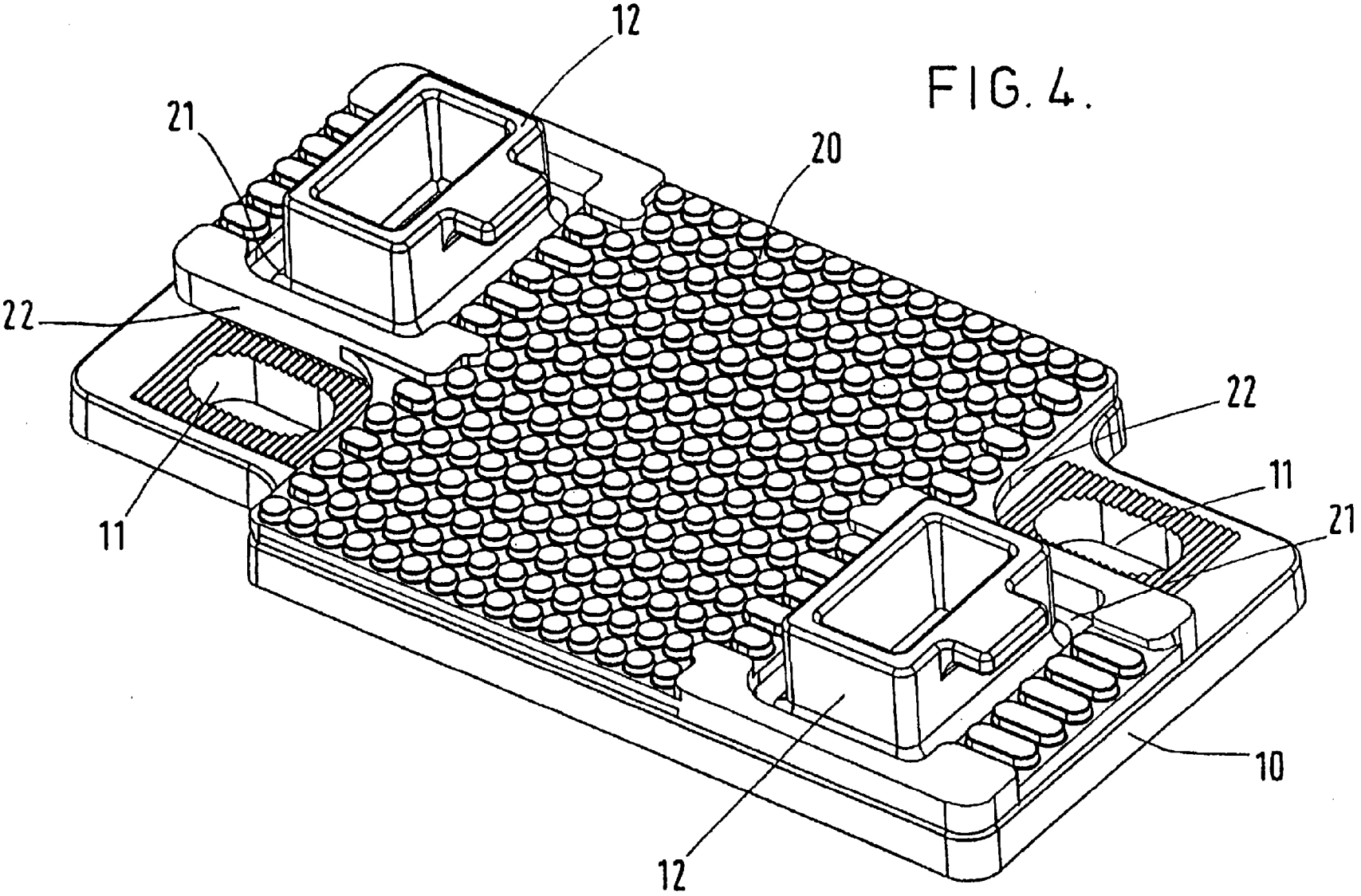
FIG. 4 shows the first part and a second part of the first rail fastening assembly embodying the present invention.

The cushioning pad 20 is shown in more detail in FIG. 4 in combination with the lower baseplate 10. The cushioning pad 20 is shaped approximately like a rectangle, of the same size as the rectangular lower baseplate 10, but having two diagonally-opposed corners 22 cut away to reveal the elongate slots 11 of the lower baseplate 10. Next to each cut-away corner 22 there is provided a rectangular hole 21 through which there projects one of the hollow studs 12 of the lower baseplate 10.

Figure 5:
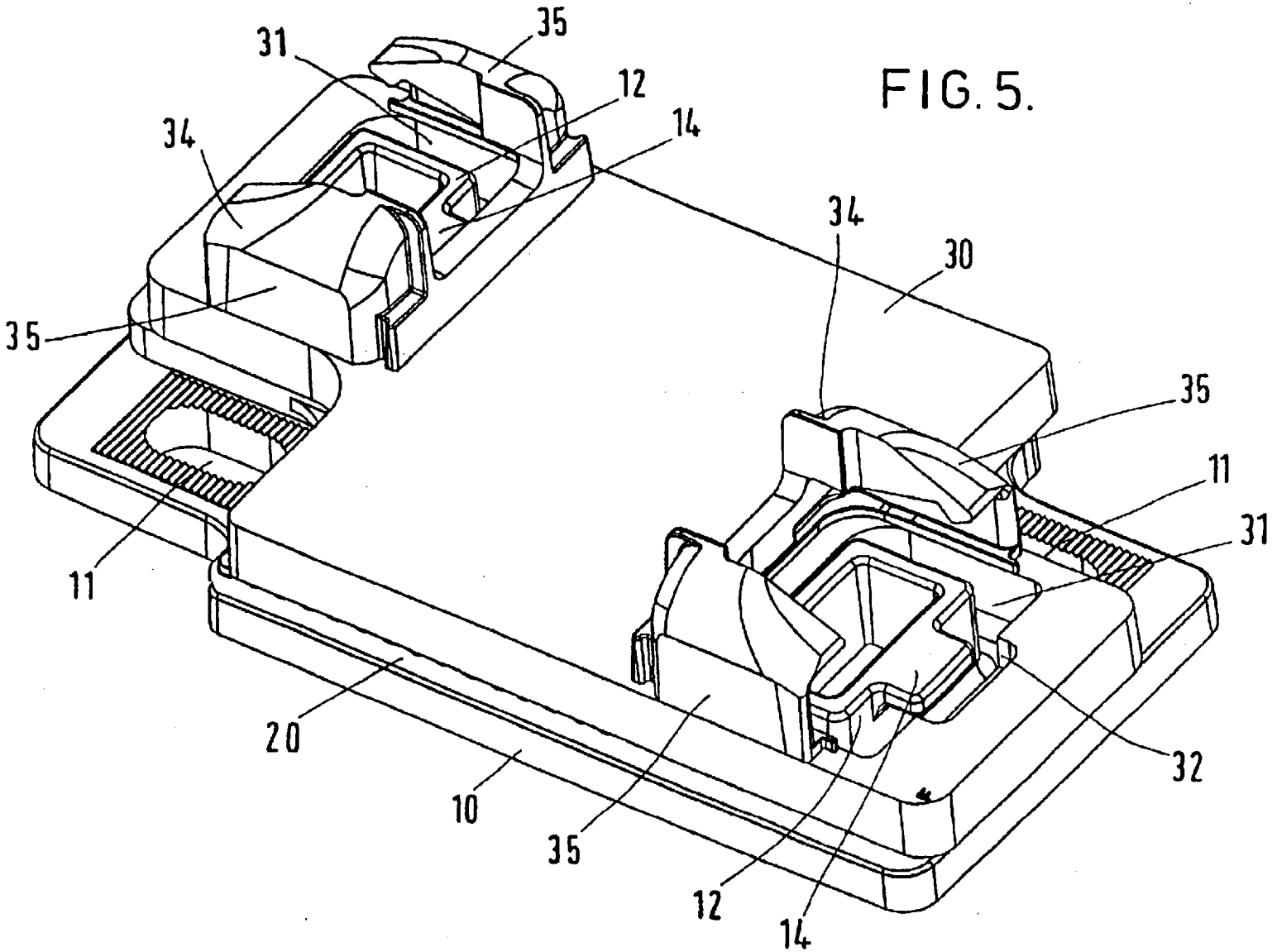
FIG. 5 shows the first and second parts and a third part of the first rail fastening assembly embodying the present invention, the third part being in a first position.
Figure 6:
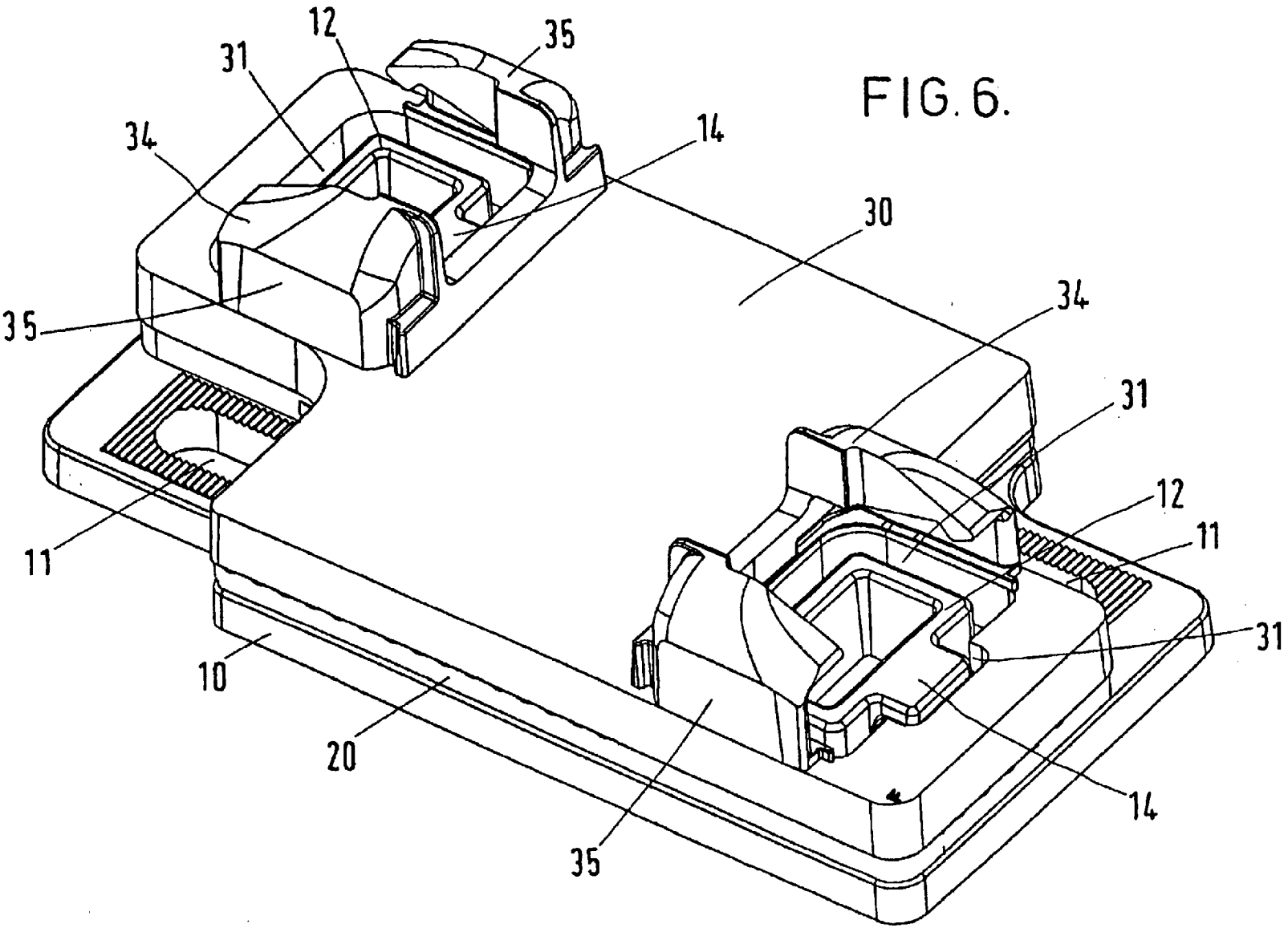
FIG. 6 shows the first, second and third parts, the third part being in a second position.

The upper baseplate 30 is shown in more detail in FIG. 5, in combination with the lower baseplate 10 and cushioning pad 20. The upper baseplate 30 comprises a plate-like member which is substantially identical in size and outline to the cushioning pad 20 beneath it. Aligned with the holes 21 of the cushioning pad 20 the upper baseplate 30 has respective holes 31. Each hole 31 has along one edge a ledge 32 for receiving the tab 14 provided on the corresponding stud 12, thereby preventing separation of the upper and lower baseplates 10, 30 through the application of vertical force alone. In FIG. 5 the upper baseplate 30 is shown in a first "unlocked" position in which it is slightly off-centre such that the tabs 14 of the studs 12 are not engaged with the ledges 32. FIG. 6 shows the upper baseplate 30 in a second "locked" position in which the tabs 14 are engaged with the ledges 32. A cushioning piece (not shown) is preferably located in the ledge 32 on the upper baseplate 30 to prevent direct contact between the upper and lower baseplates 10,30. The cushioning piece is preferably made of polyurethane material.

Around the holes 31 through which the studs 12 project are formed respective shoulders 34 for securing respective rail clips 7. The shoulders 34 have side walls 35 having features for engaging the rail clips 7. The shoulders are preferably formed integrally with the remainder of the upper baseplate 30.

Figure 7:
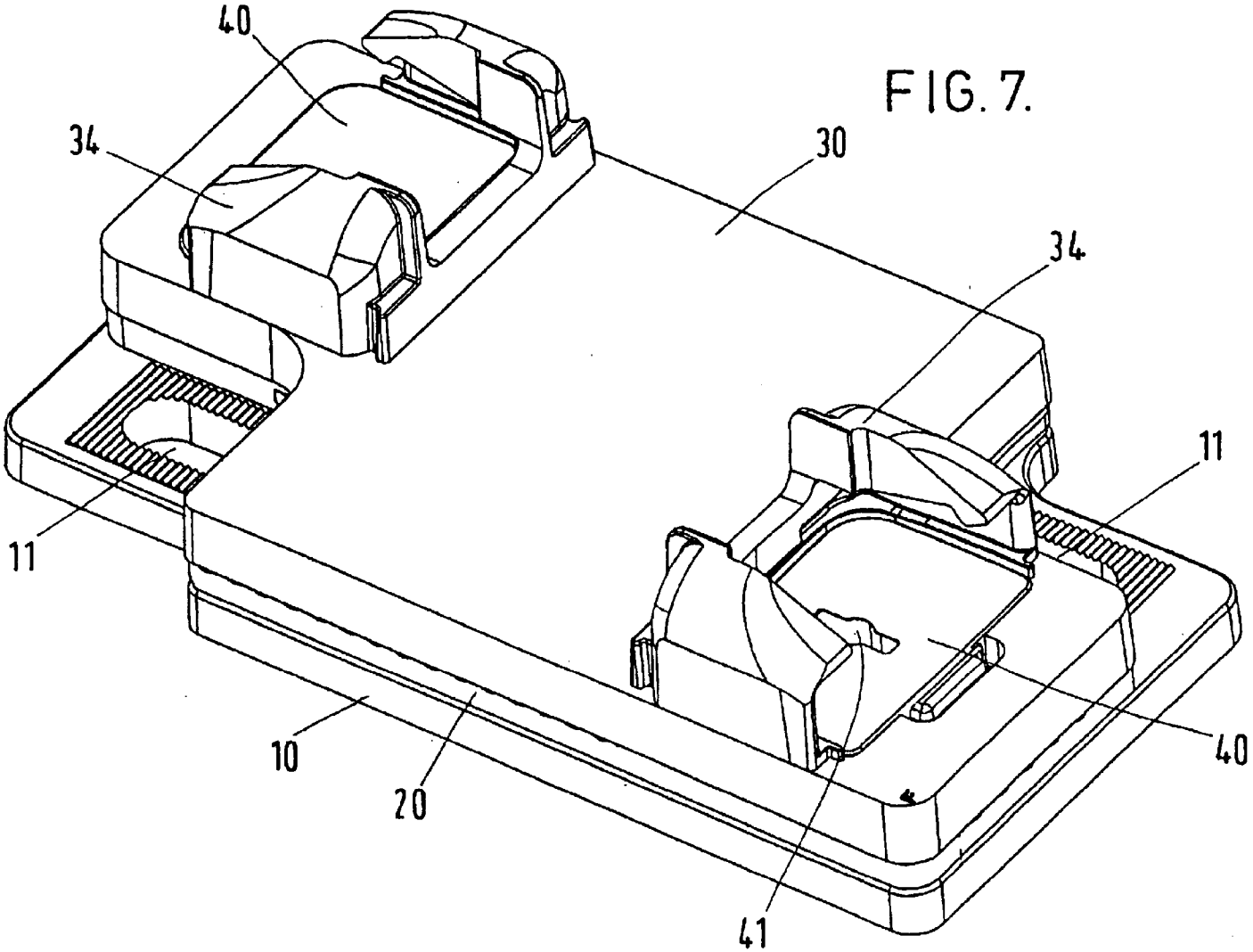
FIG. 7 shows the first to third parts and a fourth part of the first rail fastening assembly embodying the present invention.
Figure 11:
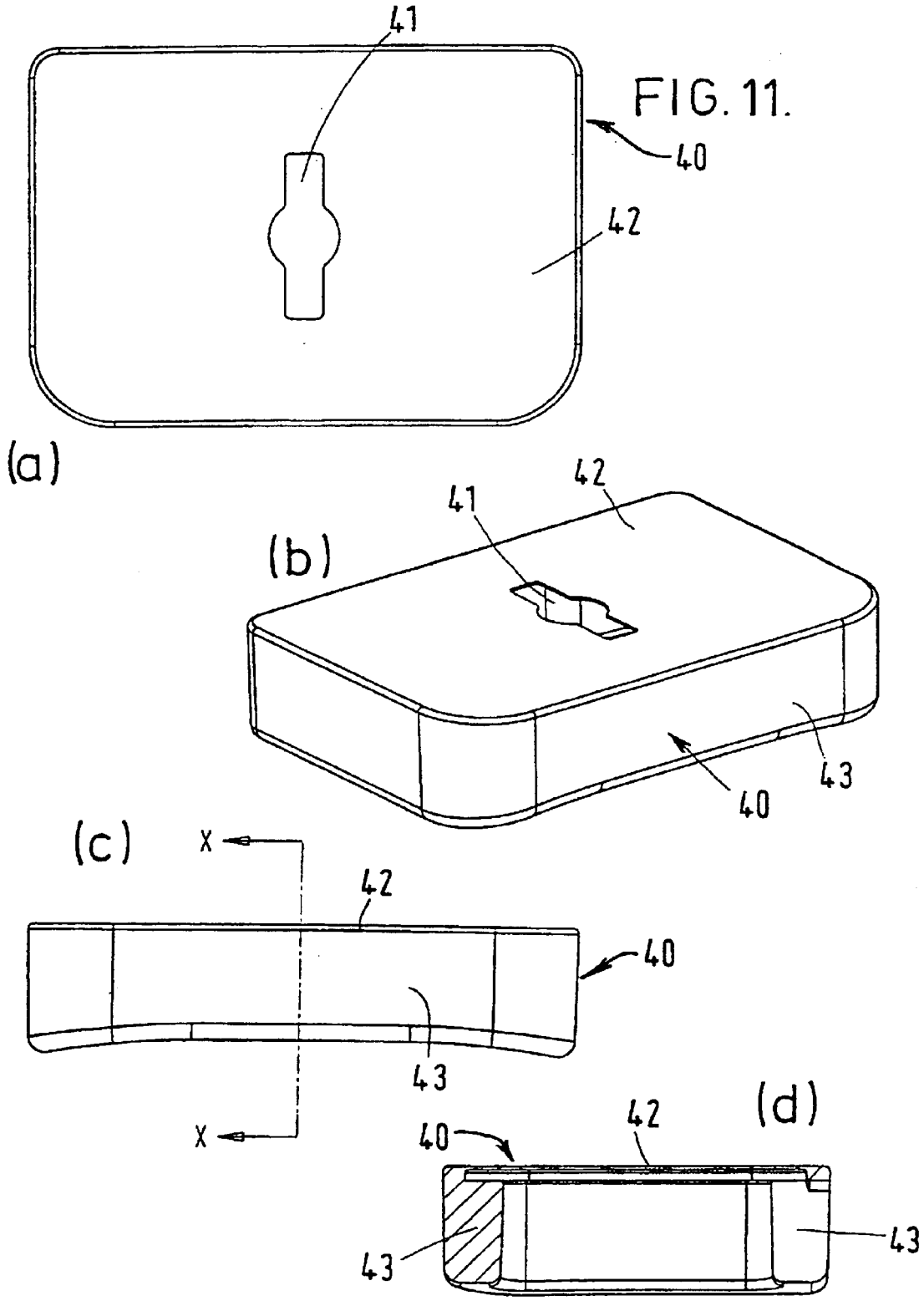
FIG. 11 shows views of the fourth part, FIG. 11*a* showing a plan view, FIG. 11*b* showing a perspective view, FIG. 11*c* showing a side view, and FIG. 11*d* showing a cross-sectional view taken along the line X—X in FIG. 11*c;*
Figure 12:
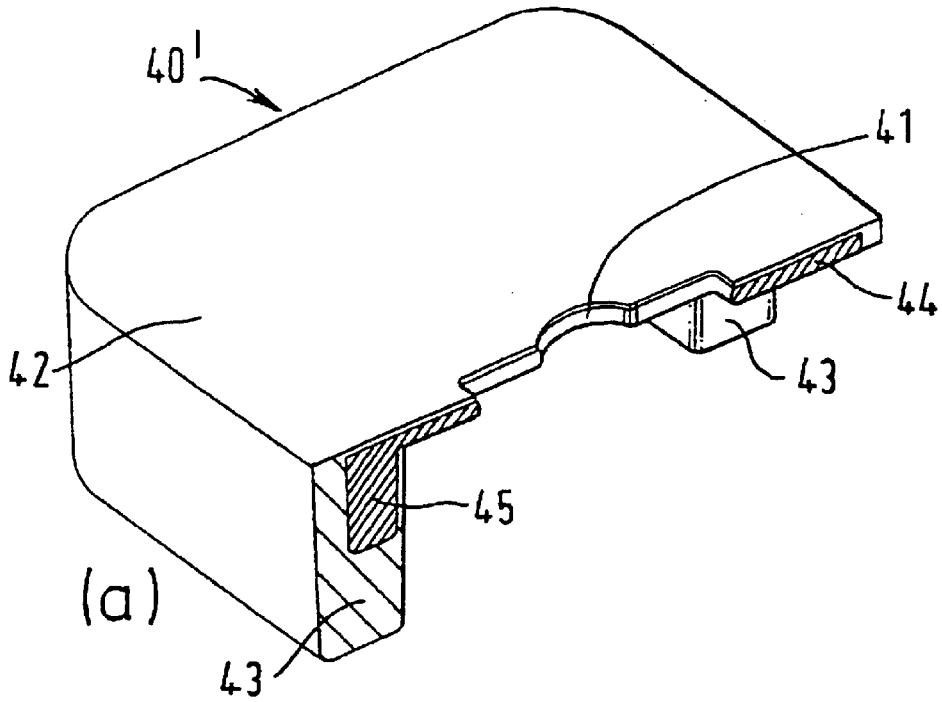
FIG. 12 shows further cross-sectional views of a modified fourth part.
Figure 12:
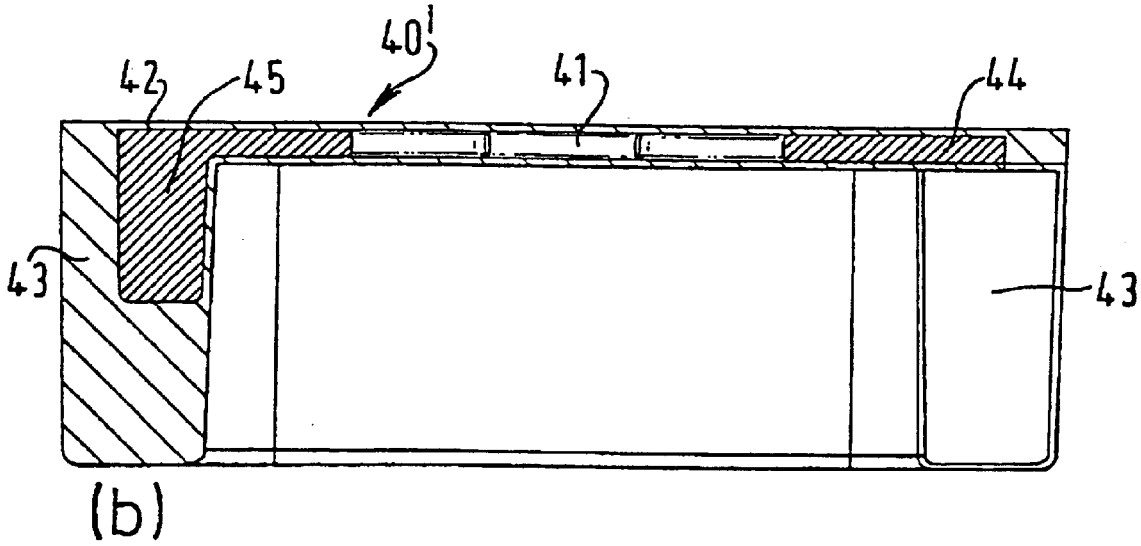

The bush 40 is shown in FIG. 7, in combination with the lower baseplate 10, the cushioning pad 20 and the upper baseplate 30, and also in more detail in FIG. 11 or 12. As shown in FIG. 11, the bush 40 slots into the hole 31 in the upper baseplate 30. The bush 40 comprises a plate 42, formed approximately centrally with a slot 41, and walls 43 which extend completely along three sides of the plate 42 and partially along the fourth side thereof. The bush 40 is desirably made of polyurethane. Once the bush 40 is installed and in position, the upper plate 30 cannot be disengaged from the lower plate 10. The cross-sectional views of FIG. 12 illustrate a modified bush 401 in which set into the plate 42 there is a reinforcing plate 44 having a wear stop 45 which is encapsulated in the front wall 43 of the bush 40'.

Figure 8:
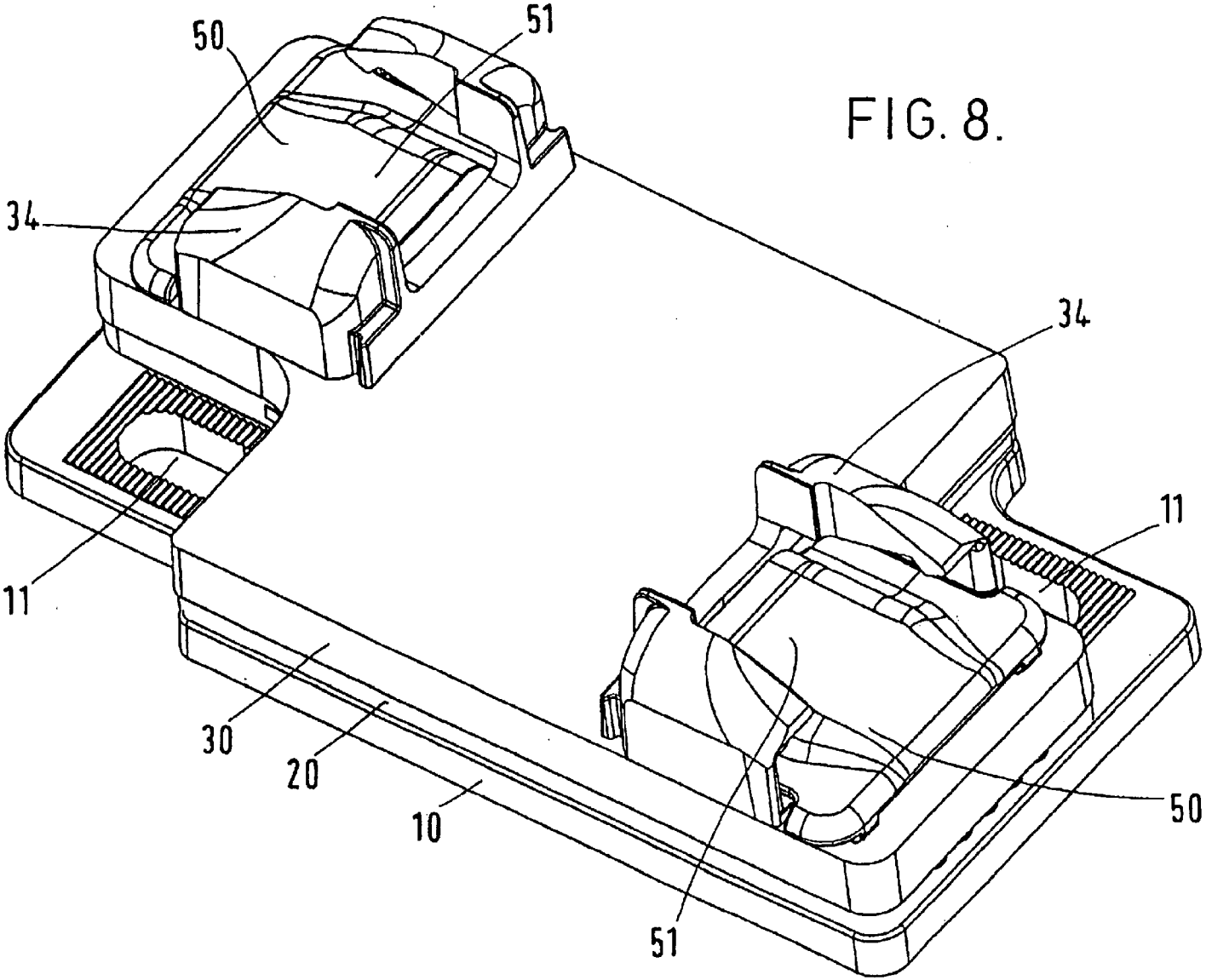
FIG. 8 shows the first to third parts and a fifth part of the first rail fastening assembly embodying the present invention.
Figure 13:
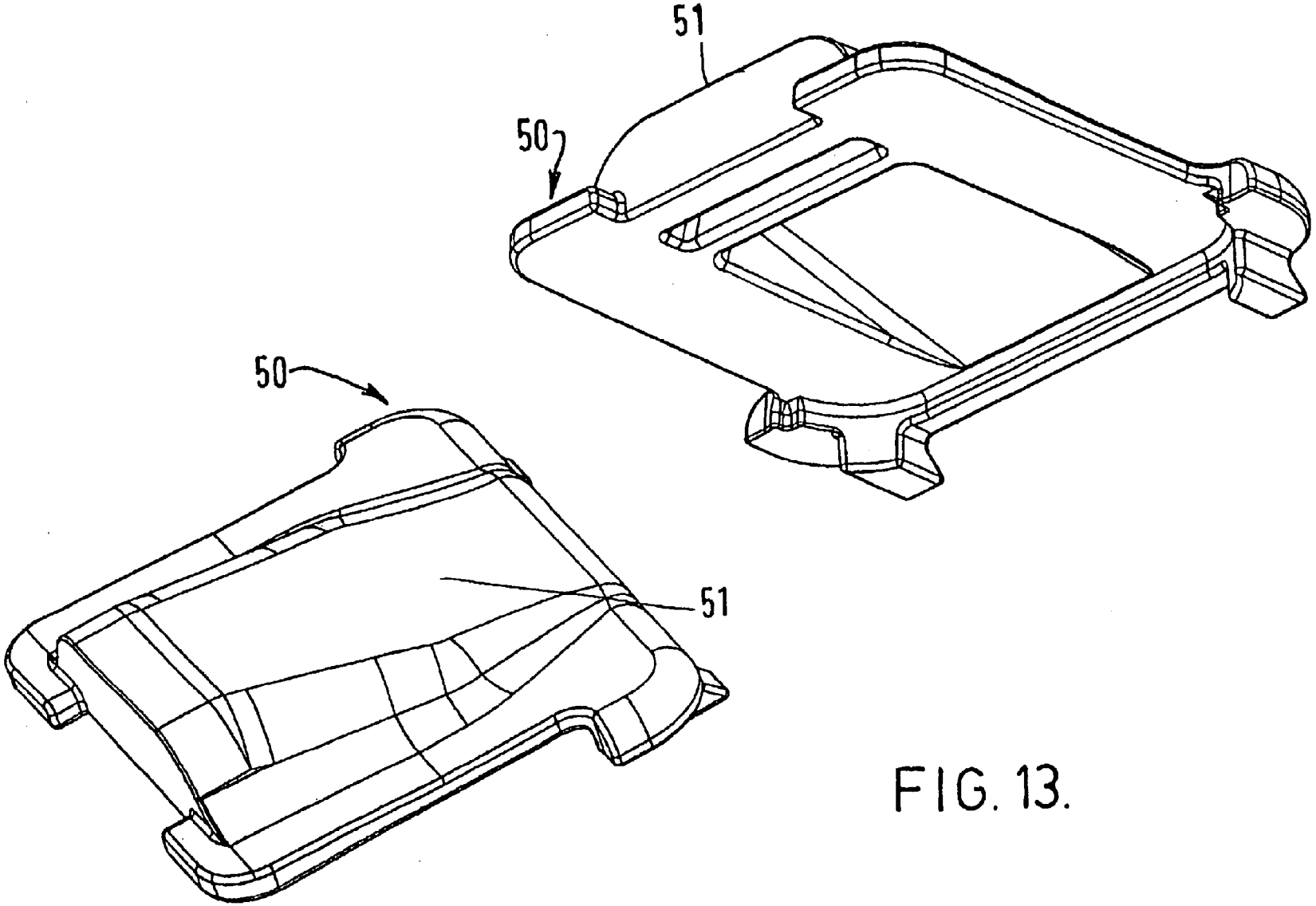
FIG. 13 shows views of the fifth part.

The cover 50 is shown in FIG. 8, in combination with the lower baseplate 10, the cushioning pad 20, the upper baseplate 30 and the bush 40 (not visible), and in more detail in FIG. 13. The cover 50 is shaped so as to fit over the hole 31 between the walls 35 of the shoulder 34. It is formed centrally with a ramp 51 up which part of the rail fastening clip 7 climbs during installation of the clip into the baseplate 30.

Figure 30:
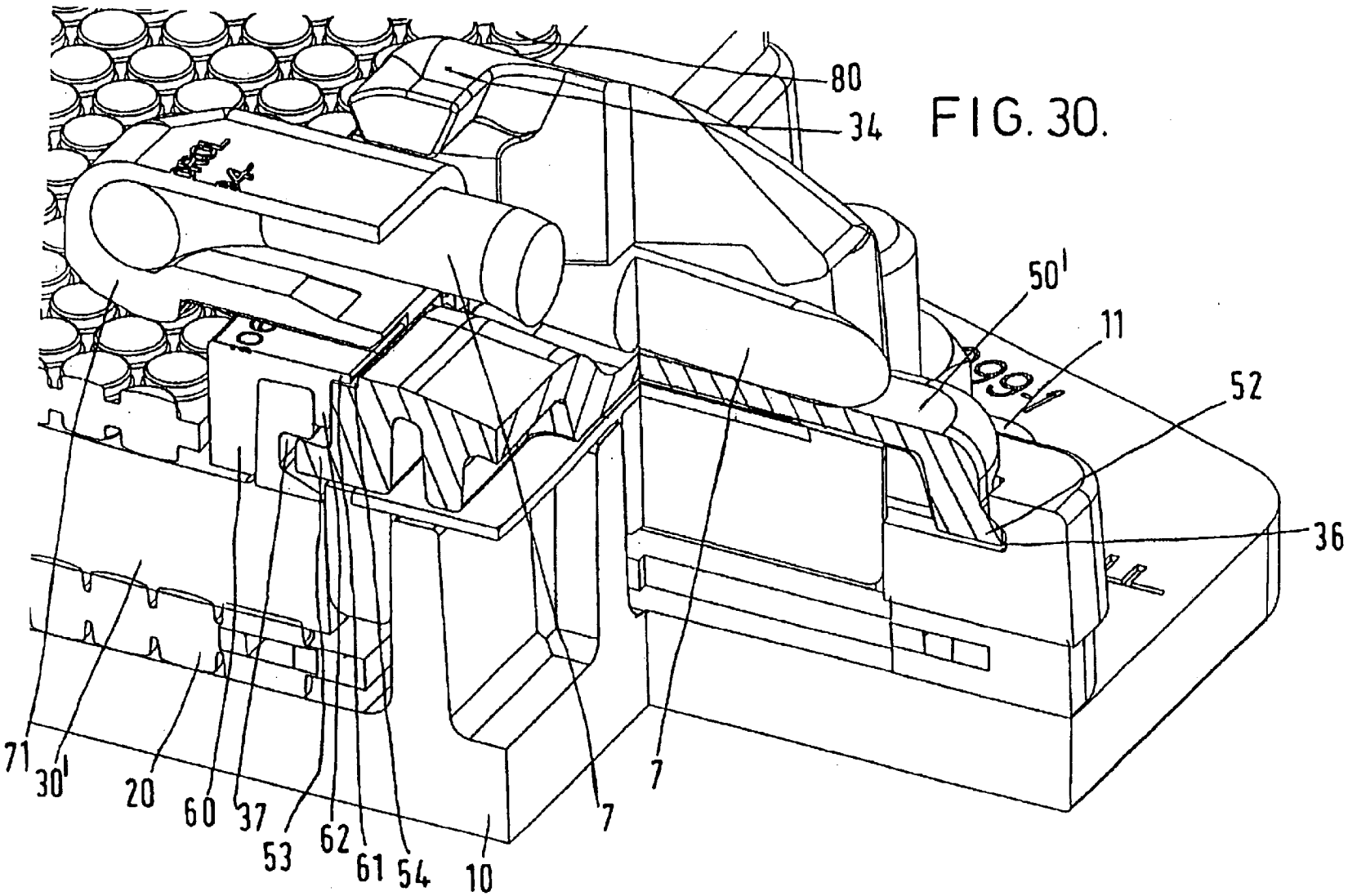
FIGS. 30 and 31 show respective partially cut-away perspective and side views of an alternative embodiment of the fifth component of the first railway baseplate.
Figure 31:
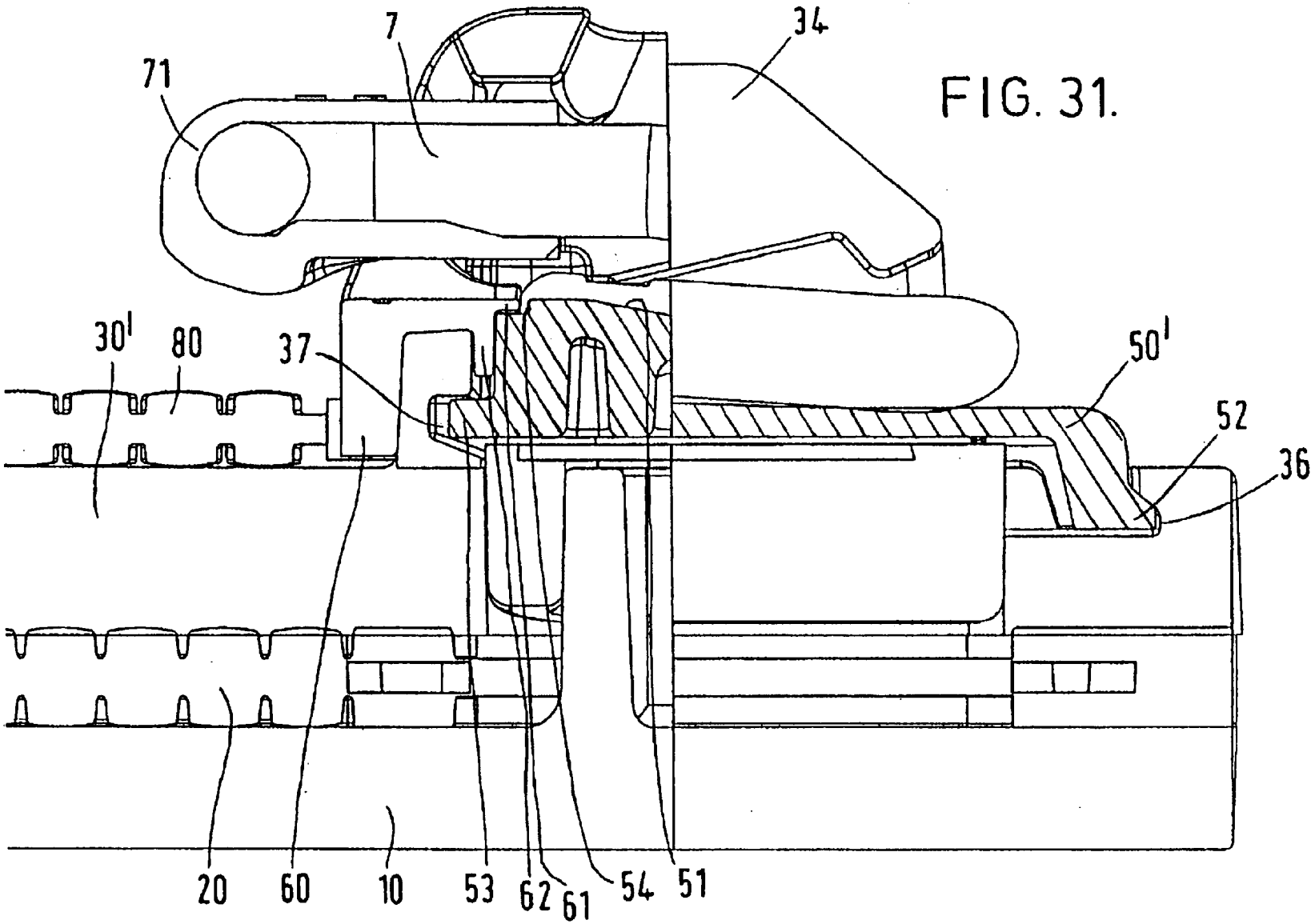

A modified cover 50' and a modified upper baseplate 301 are shown in cross-section in FIGS. 30 and 31. The cover 50' has lugs 52, 53 which engage in respective slots 36, 37 in the upper baseplate 30' in order to retain the cover 50'. FIGS. 30 and 31 also illustrate a modified sidepost insulator 60' which locks over part of the shoulder 34 by means of lugs (not shown) and has portions 61, 62 which engage a recess 54 in the cover 50' and fill the gap between the cover 50' and the shoulder 34 so as to prevent the cover 50' from becoming disengaged.

Figure 9:
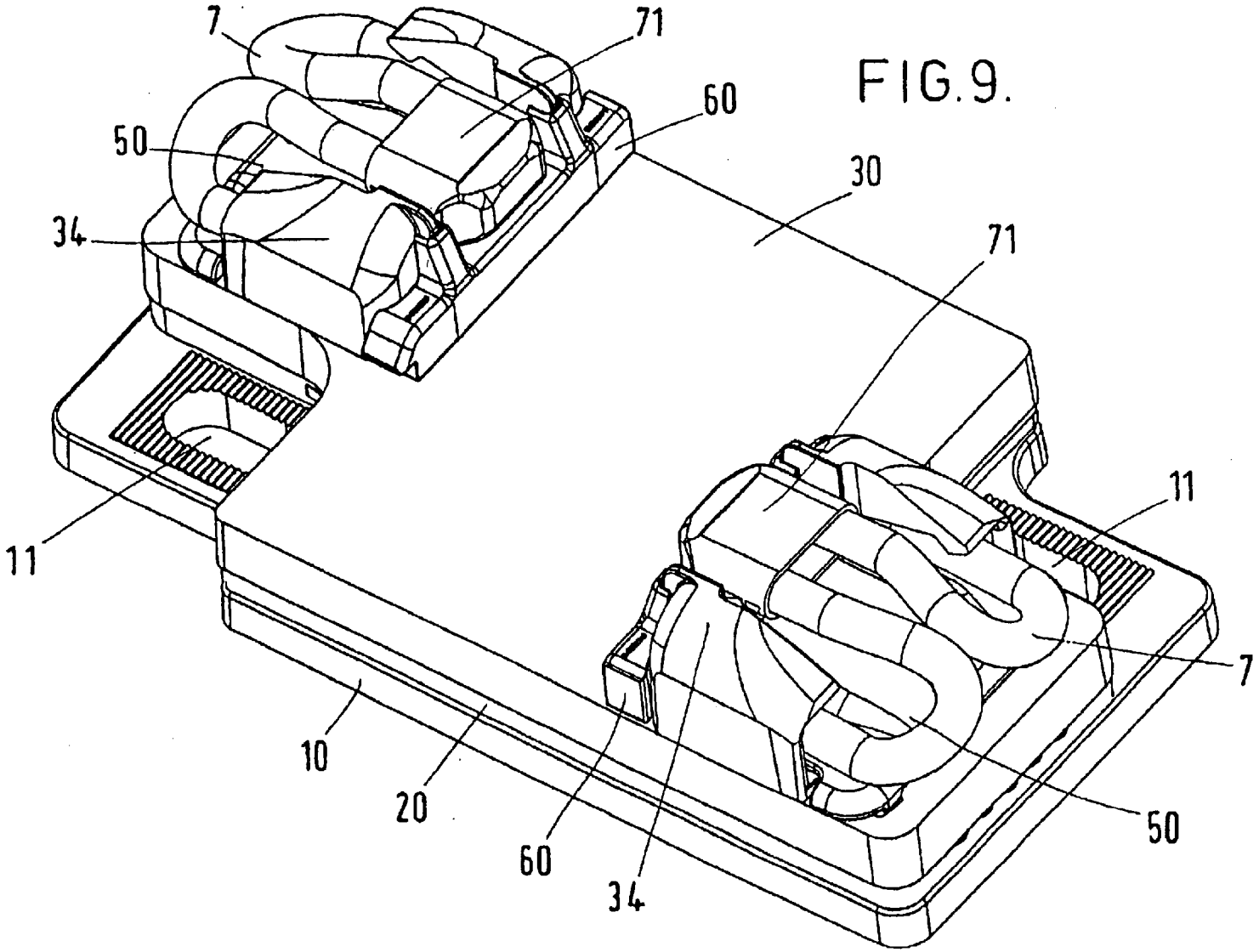
FIG. 9 shows the first, second, third, fifth and sixth parts and a seventh part of the first rail fastening assembly embodying the present invention.

The sidepost insulator 60 and the rail clip 7 are shown in more detail in FIG. 9, in combination with the lower baseplate 10, the cushioning pad 20, the upper baseplate 30, the bush 40 (not visible) and the cover 50. The rail fastening clip 7, its toe insulator 71, and the sidepost insulator 60 are of the types described in EP-B-0619851 and EP-B-0619852, which describe what the applicant has termed the FAST-CLIP™ rail fastening system. The sidepost insulator 60, which sits on part of the shoulder 34, is provided to insulate the shoulder 34 from the rail 9; the rail fastening clip 7 carries the toe insulator 71 so as to insulate the clip 7 from the rail 9. However, it should be noted that a conventional L-shaped insulator, sitting on the flange of the rail, may alternatively be used and the toe insulator 71 and sidepost insulator 60 dispensed with.

The rail clip 7 is substantially M-shaped in plan. During installation of the clip 7 into the shoulder 34 a substantially U-shaped central portion of the clip is caused to ride up the ramp 51 of the cover 50 as the outer legs of the clip 7 engage the walls 35 of the shoulder 34, thereby deflecting the clip 7.

Figure 10:
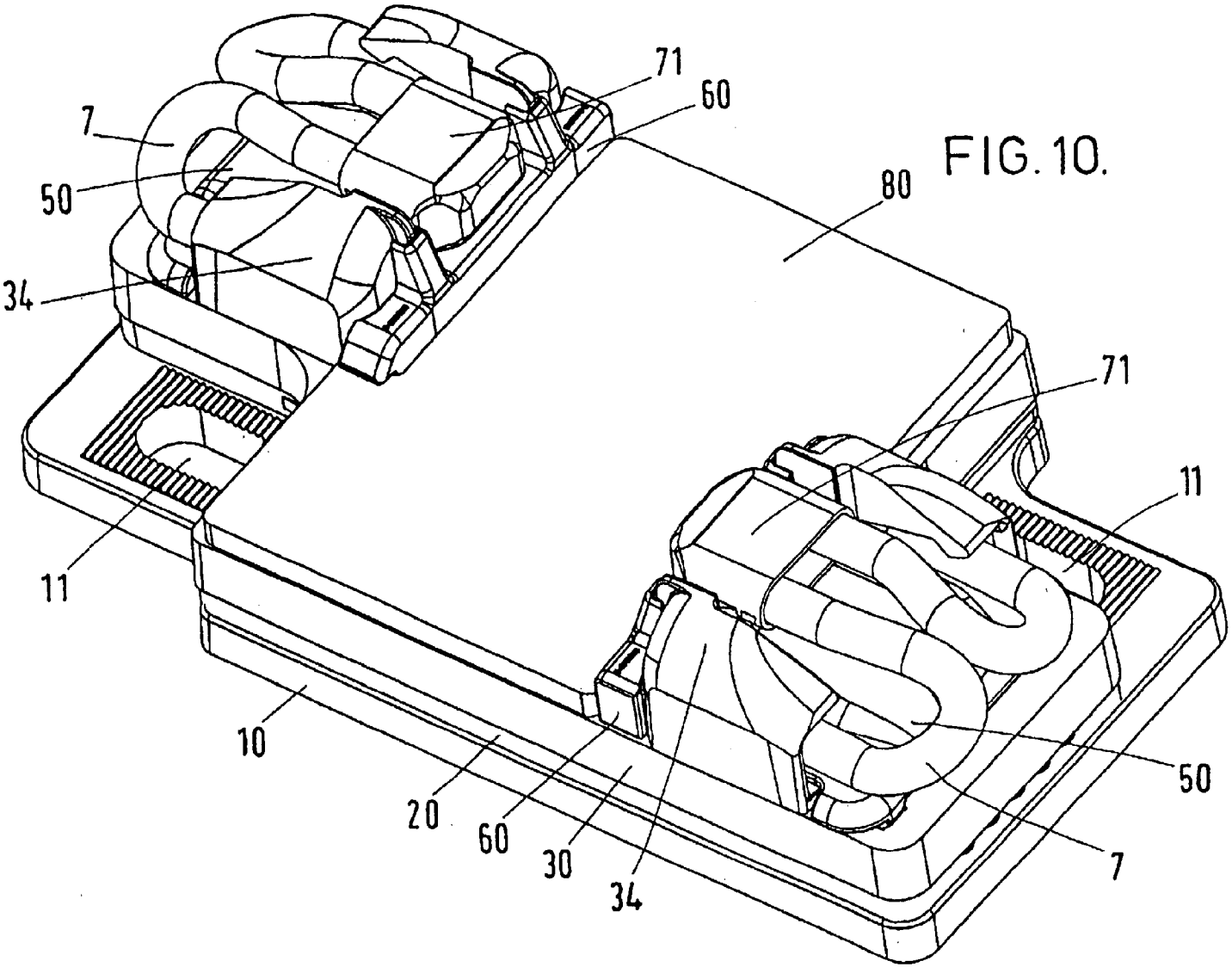
FIG. 10 shows the first, second, third, fifth, sixth and seventh parts and an eighth part of the first rail fastening assembly embodying the present invention.

The rail pad 80 is shown in more detail in FIG. 10, in combination with the lower baseplate 10, the cushioning pad 20, the upper baseplate 30, the bush 40 (not visible), the cover 50, the sidepost insulator 60 and the rail clip 7. The rail pad 80 is retained in position by the sidepost insulator 60 and may take the form of a conventional rail pad of one of many different types.

Figure 14:
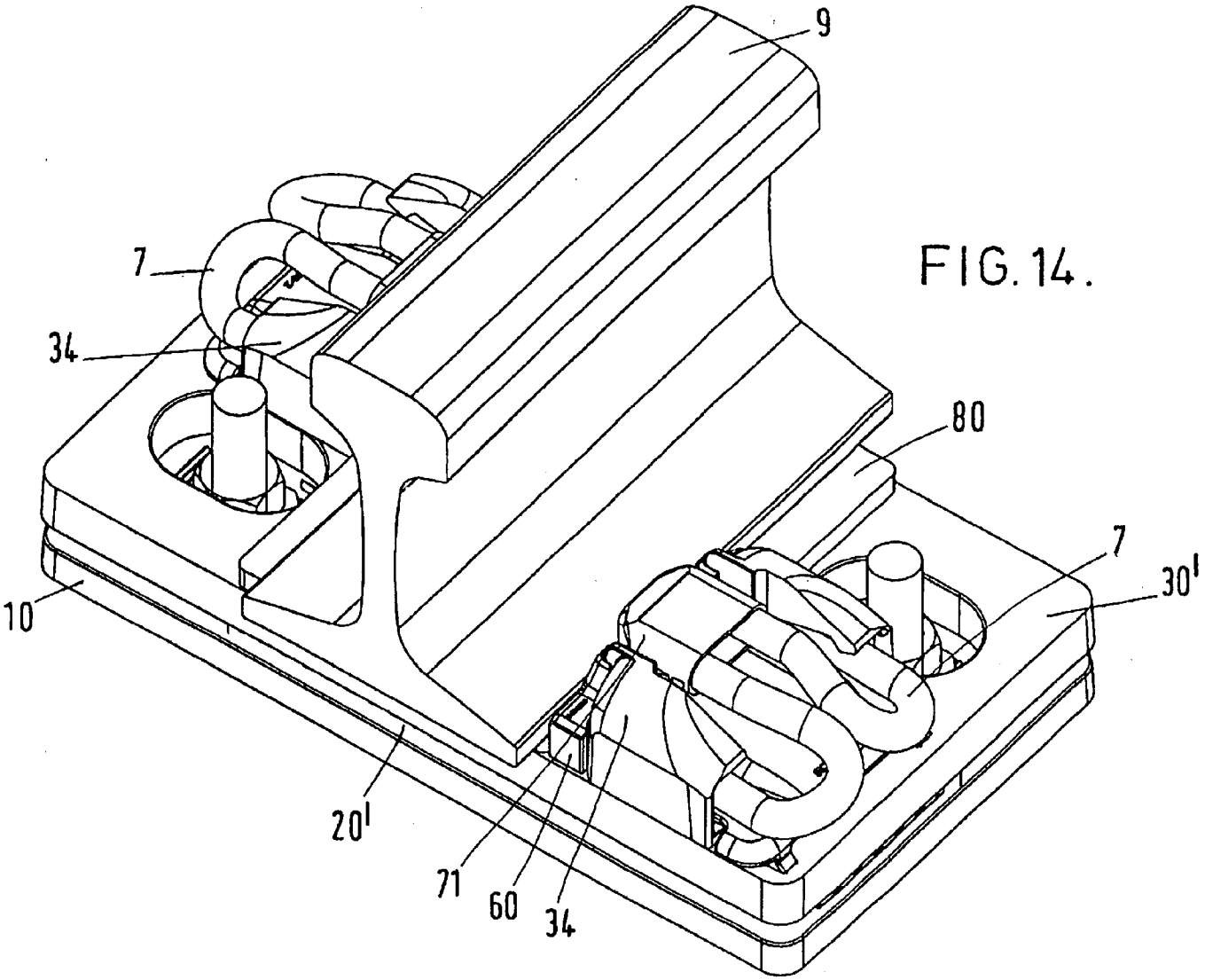
FIG. 14 shows a perspective view of a second railway baseplate assembly embodying the present invention.

FIG. 14 shows a second railway baseplate assembly embodying the present invention in which the upper baseplate 30' and cushioning pad 20' are extended so as to enable washers to be held captive between the upper and lower baseplates 30', 10' before installation, reducing the number of loose components in the assembly.

Figure 15:
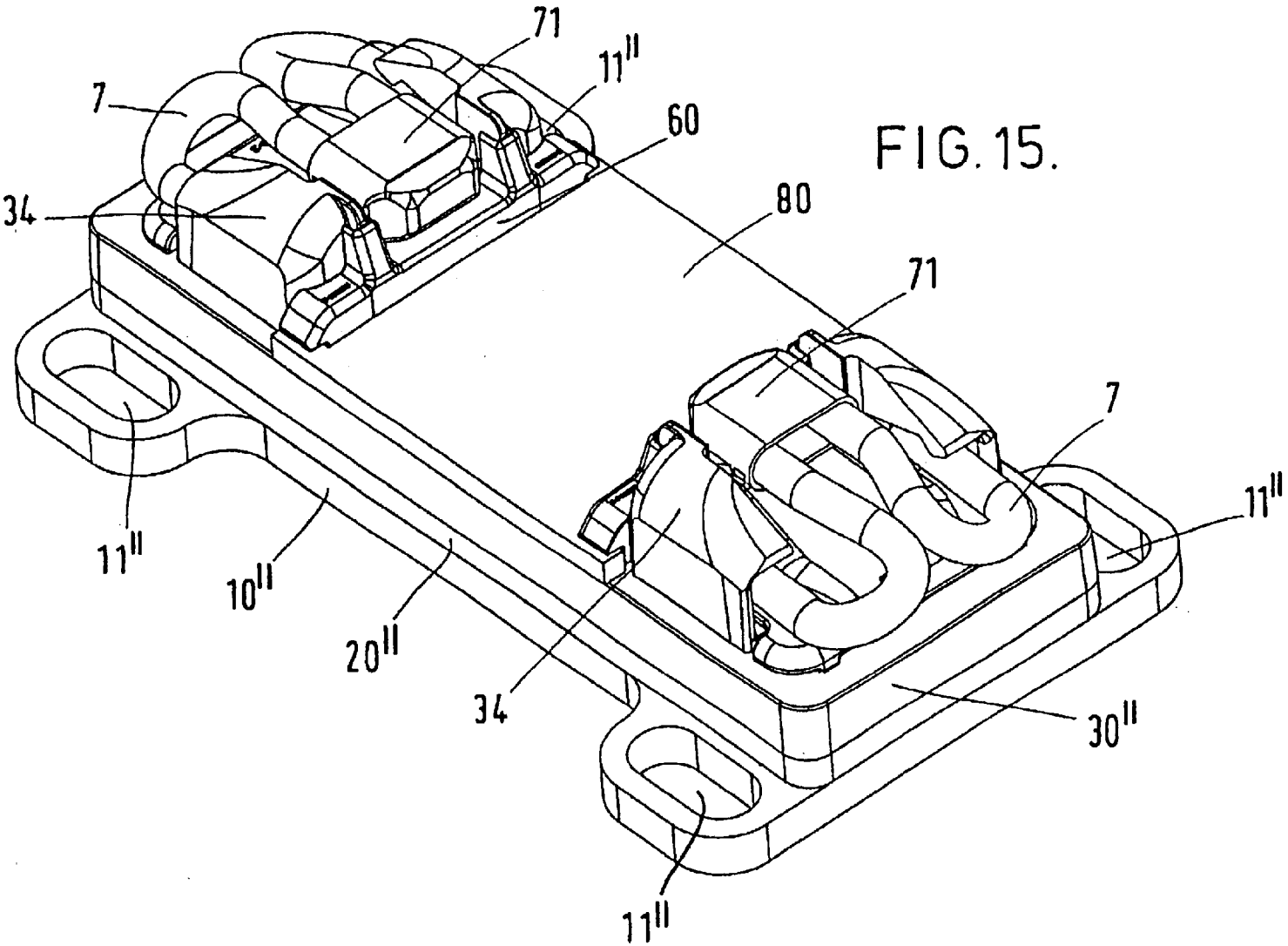
FIG. 15 shows a perspective view of a third railway baseplate assembly embodying the present invention.

FIG. 15 shows a third railway baseplate embodying the present invention, which incorporates four bolt holes 11" in the lower baseplate 10", for use in locations where two baseplate hold down fixings are not considered sufficient.

A fourth railway baseplate assembly will now be described with reference to FIGS. 16 to 25.

Figure 16:
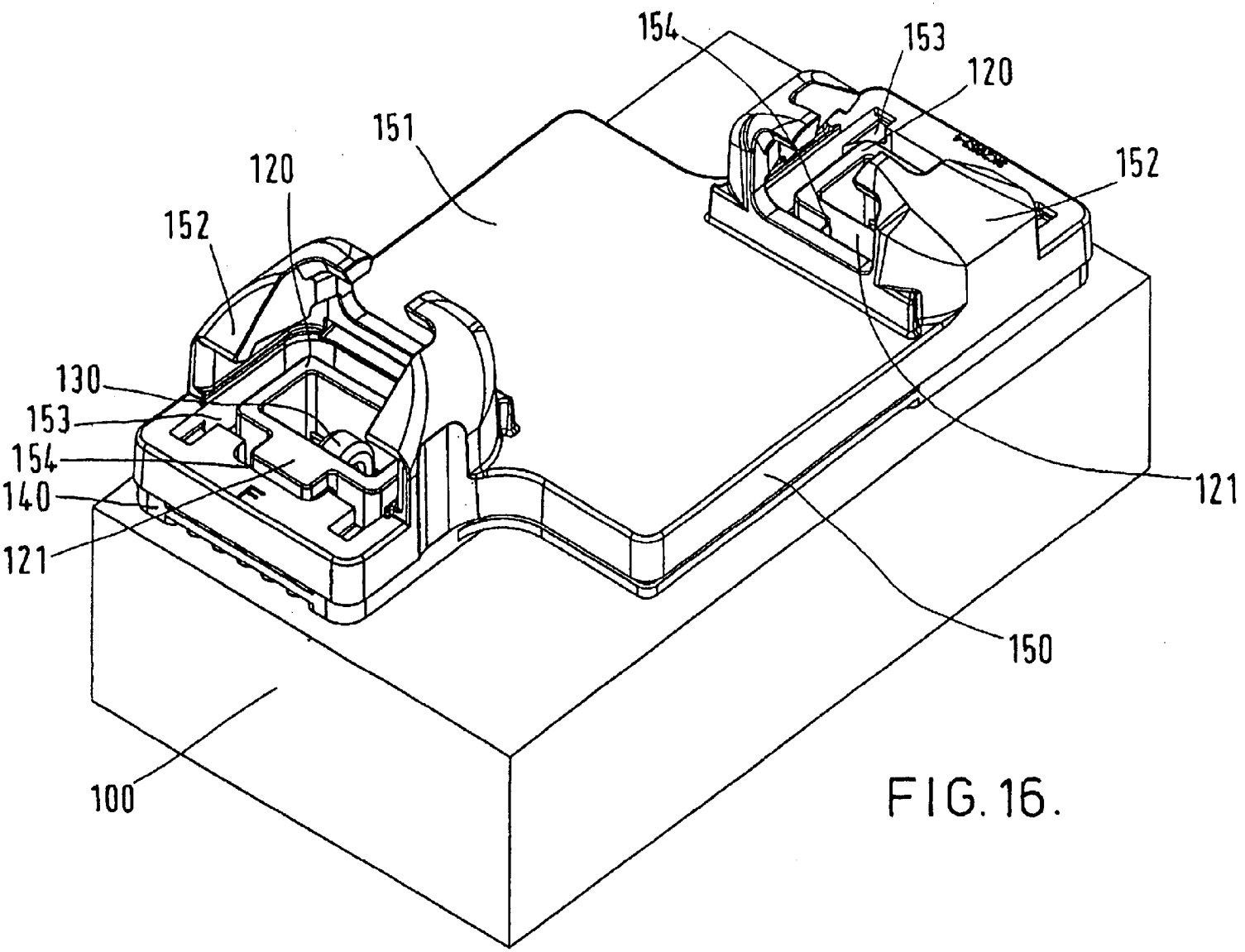
FIG. 16 shows a perspective view of a fourth railway baseplate assembly embodying the present invention.

FIG. 16 shows the fourth railway baseplate assembly installed on a concrete railway sleeper 100. The railway baseplate assembly comprises a baseplate 150, for example made of cast iron, having a central rail seat area 151 for receiving a rail pad (not shown) and rail (also not shown). On either side of the rail seat area 151 are respective shoulders 152 for receiving rail fastening clips (not shown) for holding the rail down to the baseplate 150 and also for locating the sidepost insulators (not shown). Between the underside of the baseplate 150 and the upper surface of the concrete sleeper 100 is a cushioning pad 140 made of resilient material. The baseplate 150 is secured to the underlying concrete sleeper 100 by means of post members 120 which pass through respective holes in the baseplate 150, each post member 120 having a laterally-extending tab 121 which overlies part of the baseplate 150, the post members 120 being held within respective post housings 110 (not shown in FIG. 16) embedded in the concrete sleeper 100. The post members 120 are held in position in the post housing 110 by respective wedge m embers 130 and are partially surrounded by cushioning bushes (not shown) within the post housings 110, as in the first embodiment.

Figure 17:
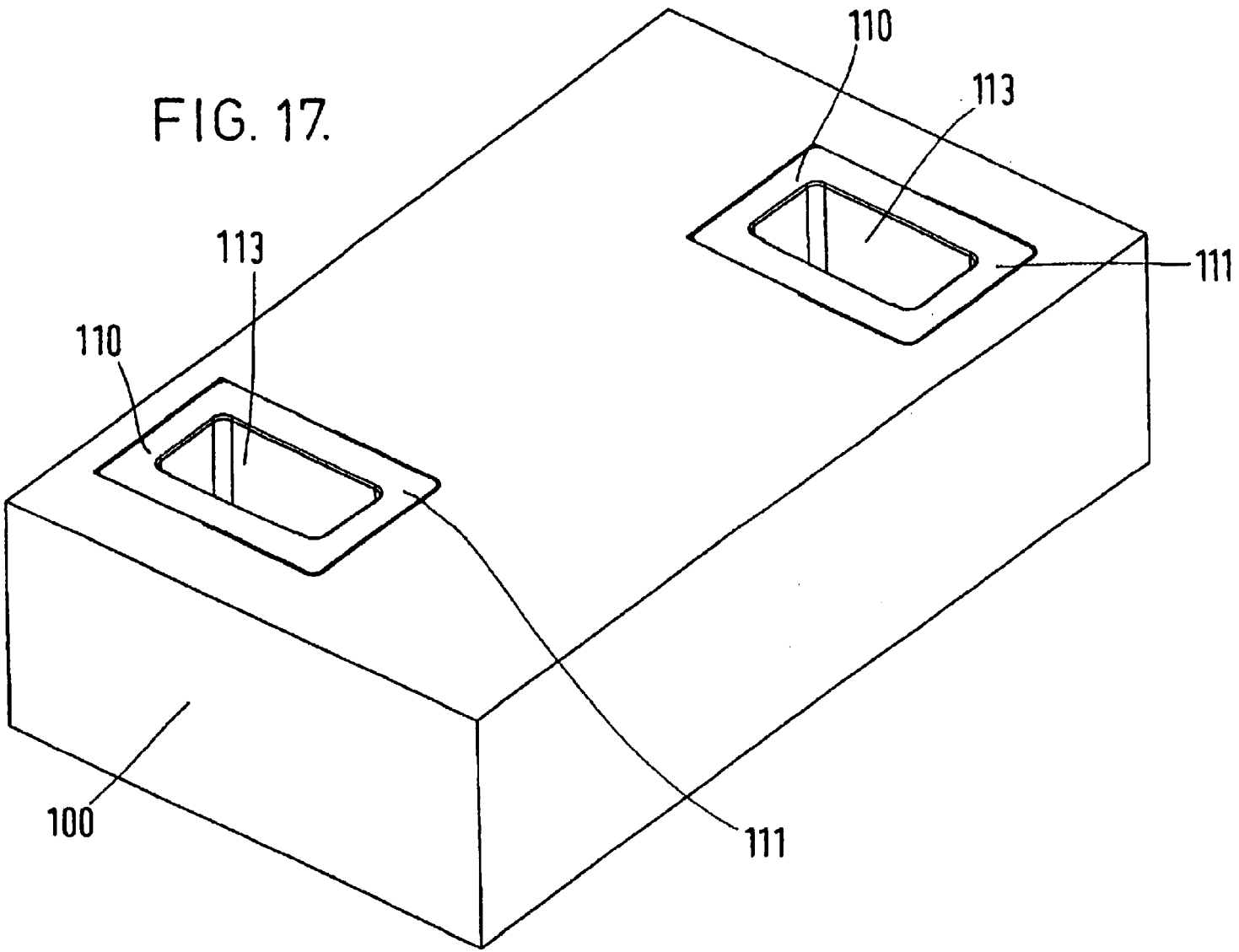
FIGS. 17 and 18 shows respective perspective and partially cut-away views of parts of a railway sleeper for use in the railway baseplate assembly of FIG. 16, which sleeper incorporates a first component of the said assembly.
Figure 18:
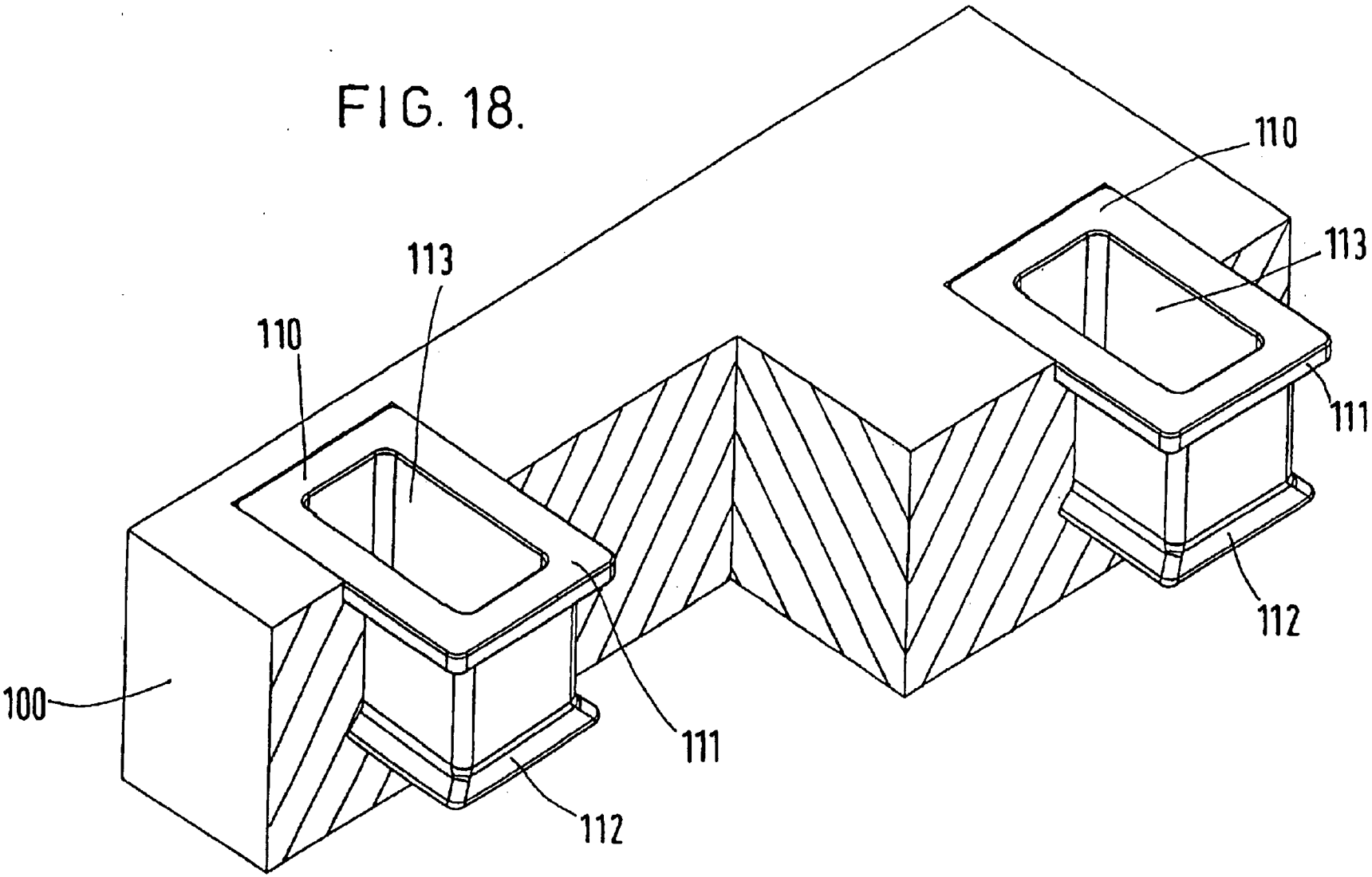
Figure 19:
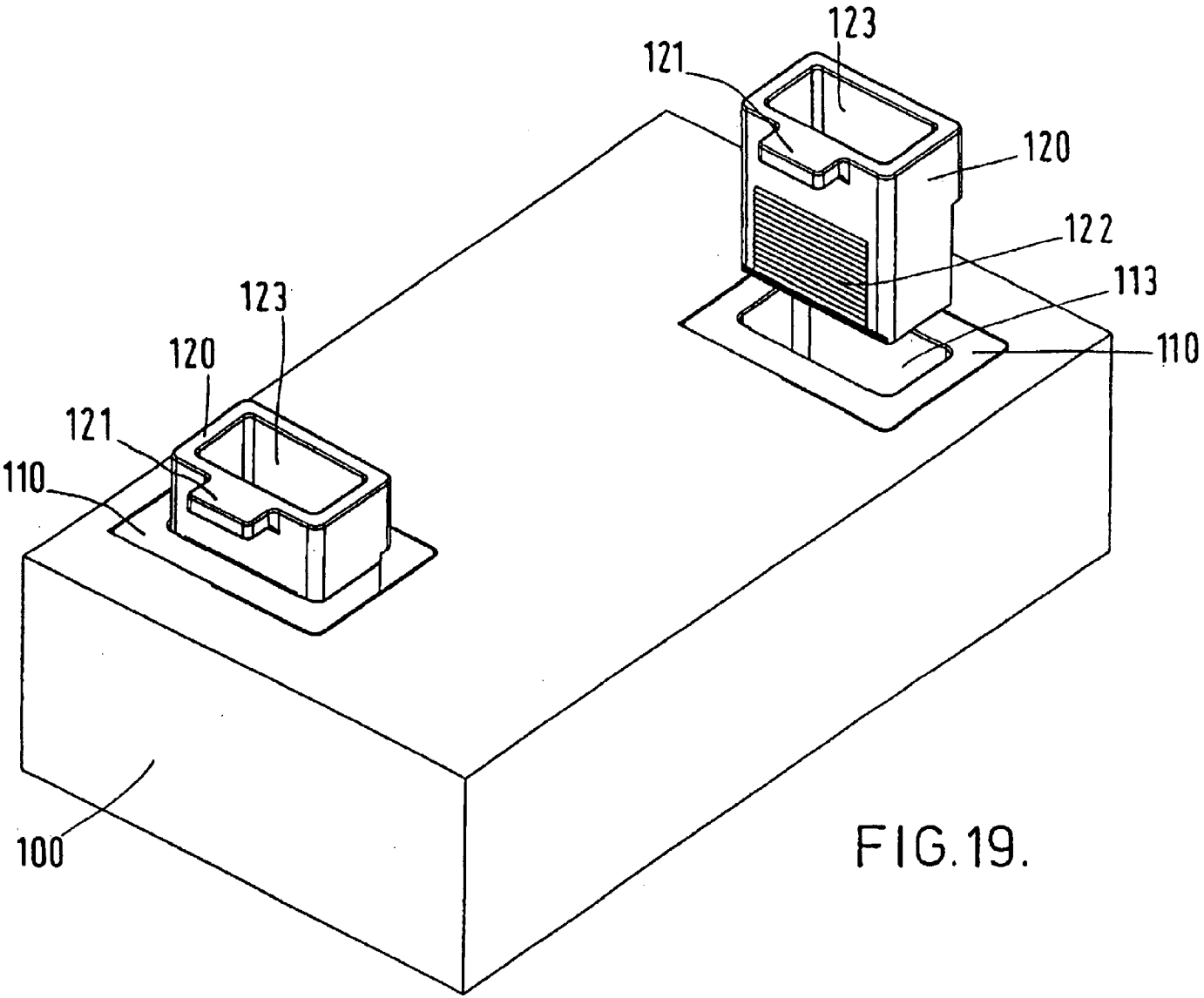
FIG. 19 shows a perspective view of parts of the railway sleeper of FIGS. 17 and 18 together with a second component of the assembly of FIG. 16.
Figure 20:
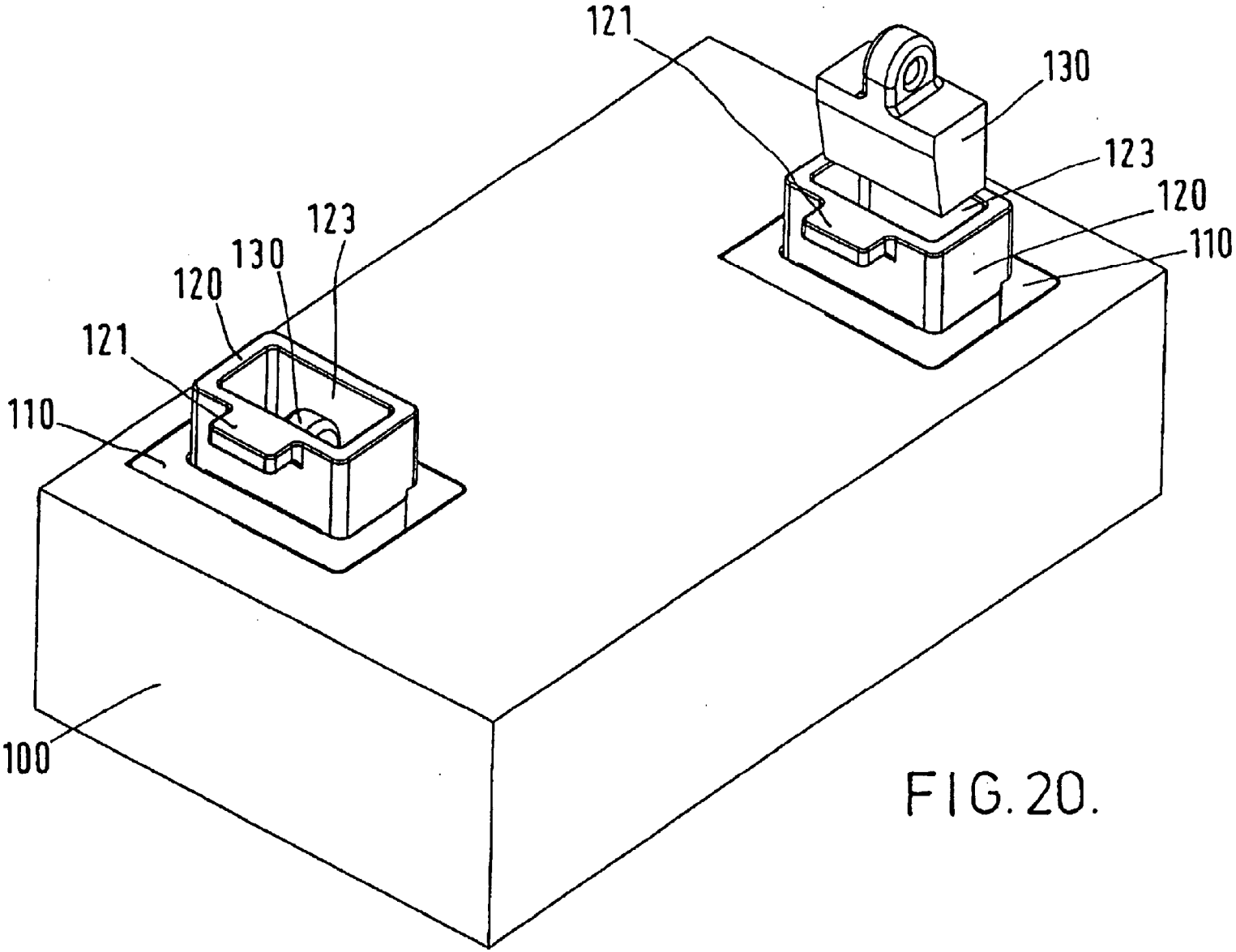
FIG. 20 shows a perspective view of the railway sleeper of FIGS. 17 and 18 together with the second and a third component of the assembly of FIG. 16 during installation.
Figure 21:
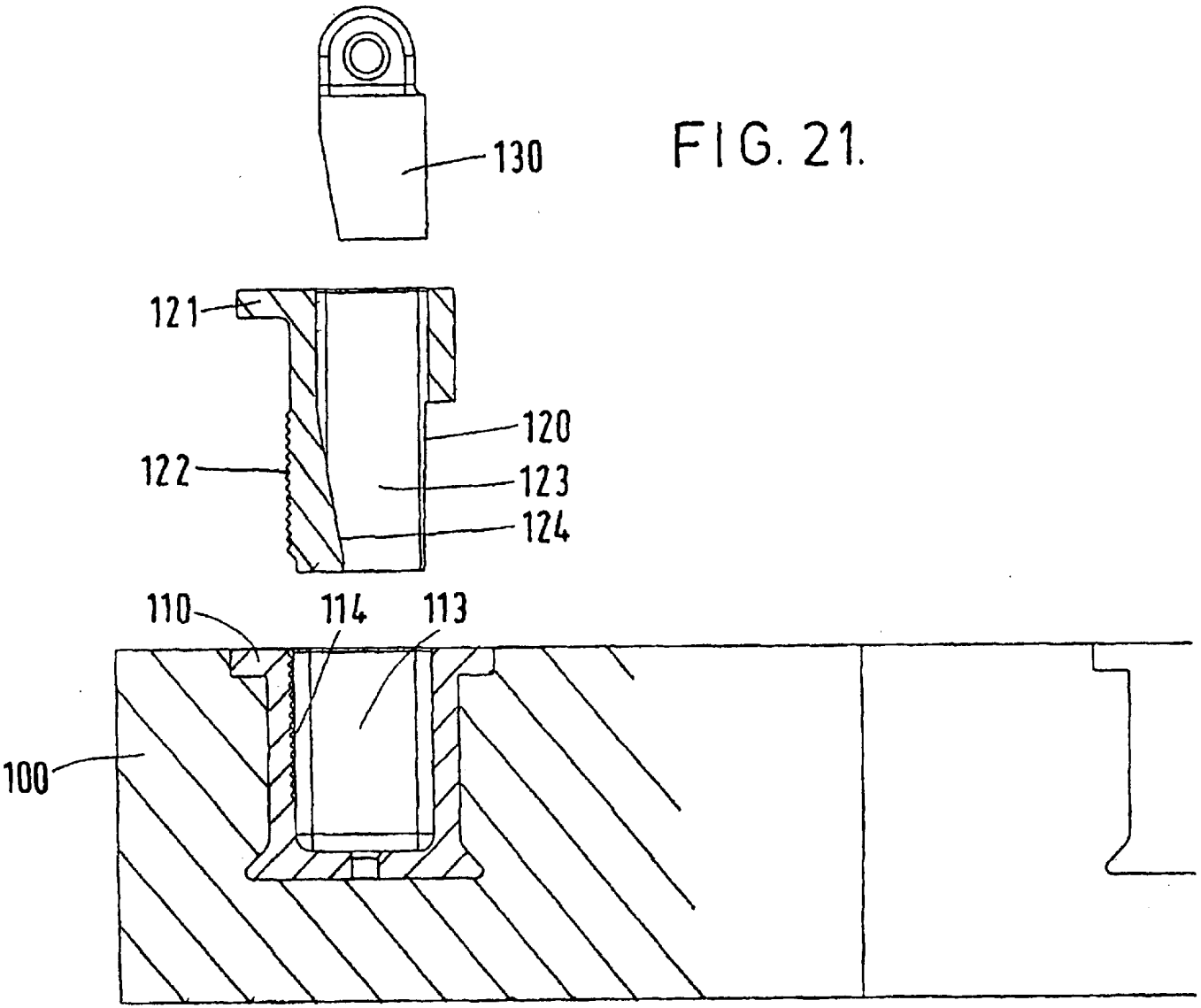
FIG. 21 shows an exploded partial cross-sectional side view of the sleeper and components of FIG. 20.
Figure 22:
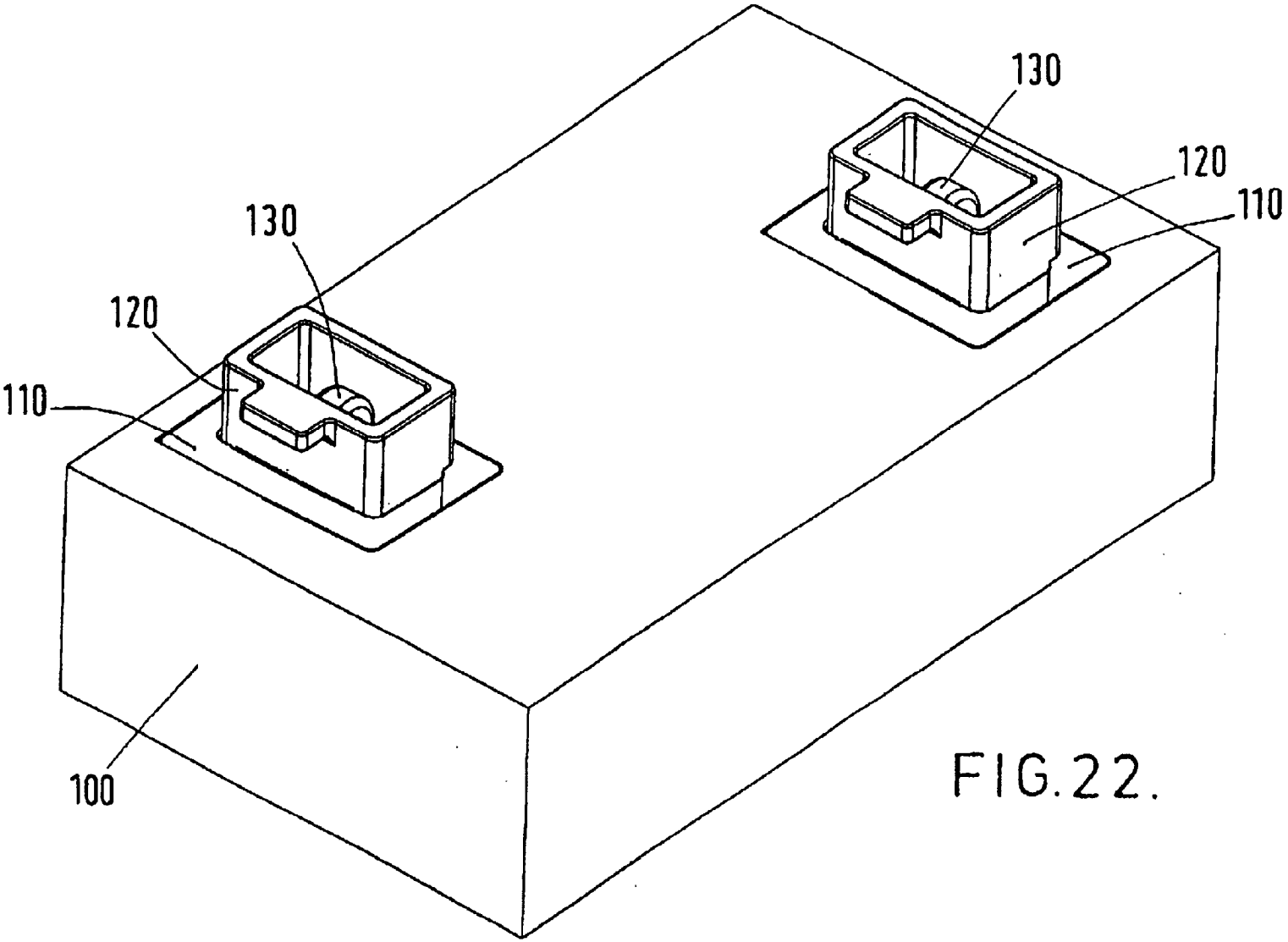
FIGS. 22 and 23 show respective perspective and partial cross-sectional side views of the sleeper and components of FIG. 18 in an installed condition.
Figure 23:
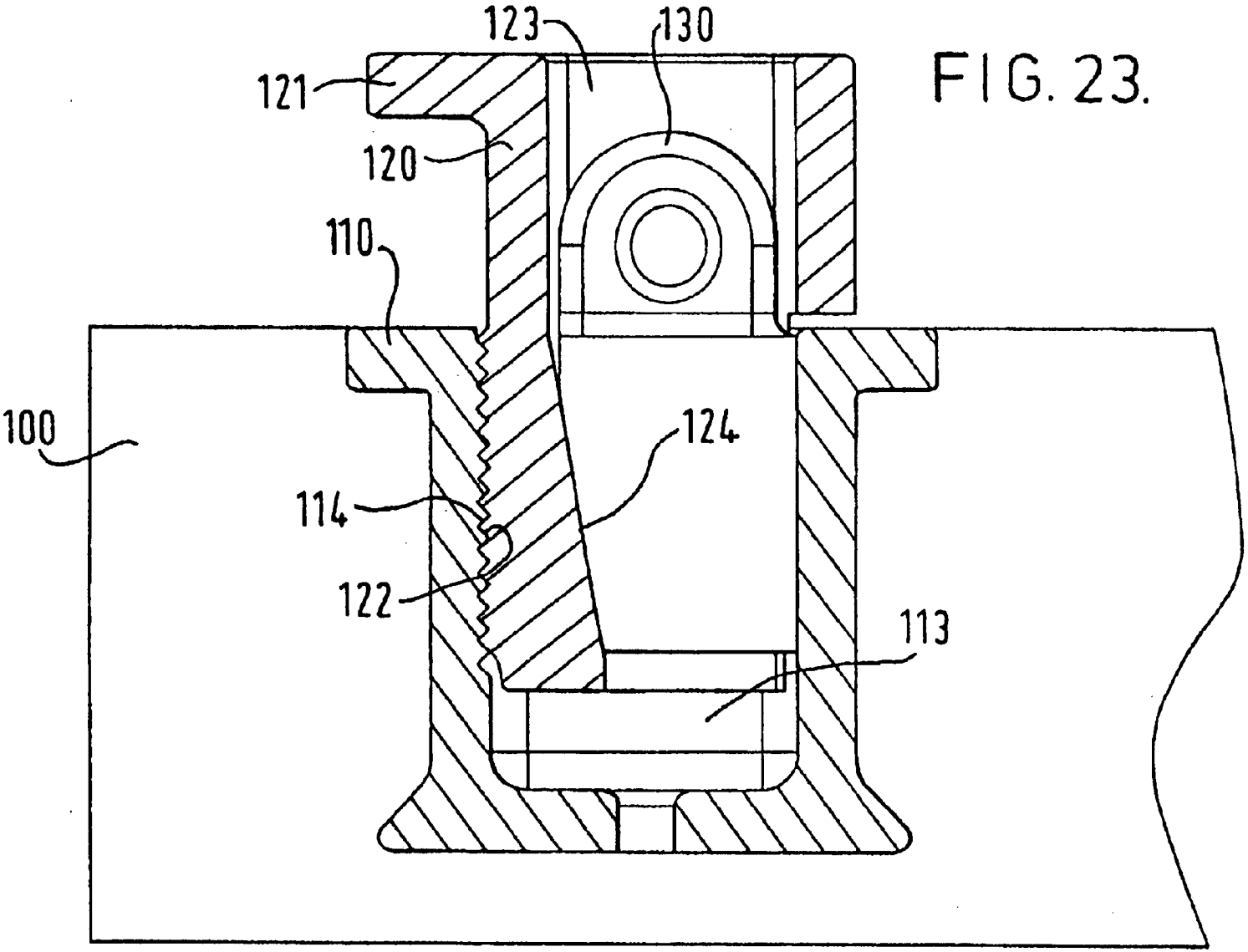

The post housings 110 are shown in more detail in FIGS. 17 and 18. Each post housing 110 is substantially rectangular in cross-section. At the top and bottom of the housing 110 respective lips 111 and 112 are formed so as to inhibit movement of the housing 110 when it is embedded in the concrete sleeper 100.

Figure 24:
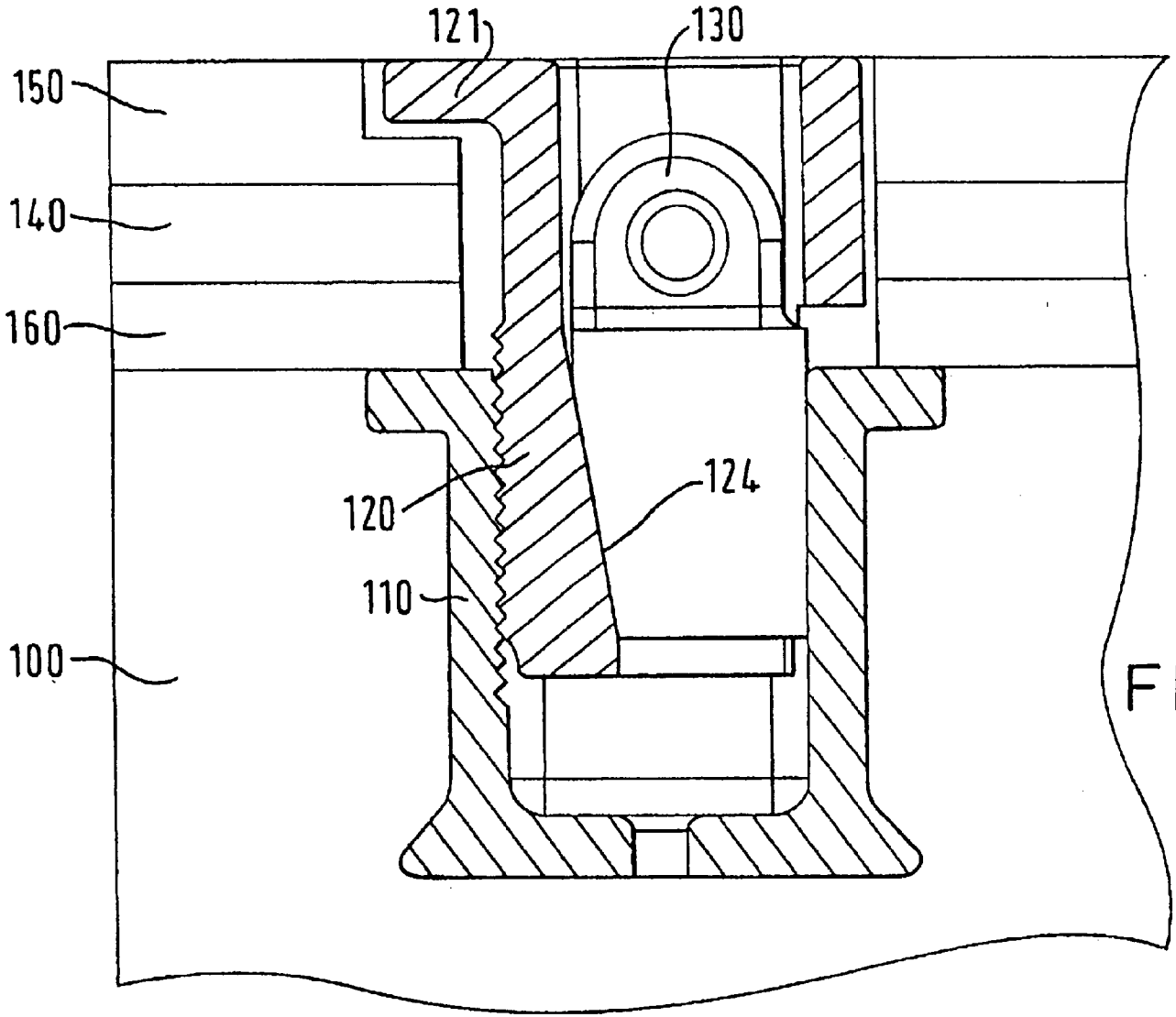
FIG. 24 shows a partial cross-sectional side view of the components of FIG. 20 in an alternative installed condition.

Each housing 110 has an opening 113 into which an associated post member 120 is inserted, as shown in more detail in FIGS. 19 to 24. Each post member 120 is shaped so as to slot into opening 113 of the post housing 110. On an external face of the post member 120 a region is formed with serrations 122. When the post member 120 is inserted into the post housing 110 the serrations 122 can interlock with serrations 114 formed on a corresponding internal face within the opening 113 of the housing 110. The serrations 114 within the post housing 110 are towards the top of the opening 113, whereas the serrations 122 on the post member 120 are towards the bottom of the post member, at the end opposite to that at which the tab 121 is formed. The depth of the post housing 110 is less than the length of the post member 120. Accordingly, when the post member 120 is inserted into the opening 113 of the post housing 110 to its fullest extent it protrudes above the top of the housing 110. The post member 120 has an aperture 123 running through its length, one face 124 of the aperture 123 being tapered so as to receive the wedge member 130, one tapered face of the wedge member 130 bearing against the face 124 of the post member 120 and an opposite face of the wedge member 130 bearing, through an opening in the side of the post member 120, on an internal face of the opening 113 in the post housing 110. Height adjustment of the post member 120 relative to the post housing 110 is achieved by incremental engagement of the two sets of serrations, 114, 122, the minimum adjustment achievable being one tooth pitch. A shim 160 of appropriate thickness is placed beneath the cushioning pad 140 of the assembly to support the baseplate 150 at the desired height, as shown in FIG. 24.

Figure 25:
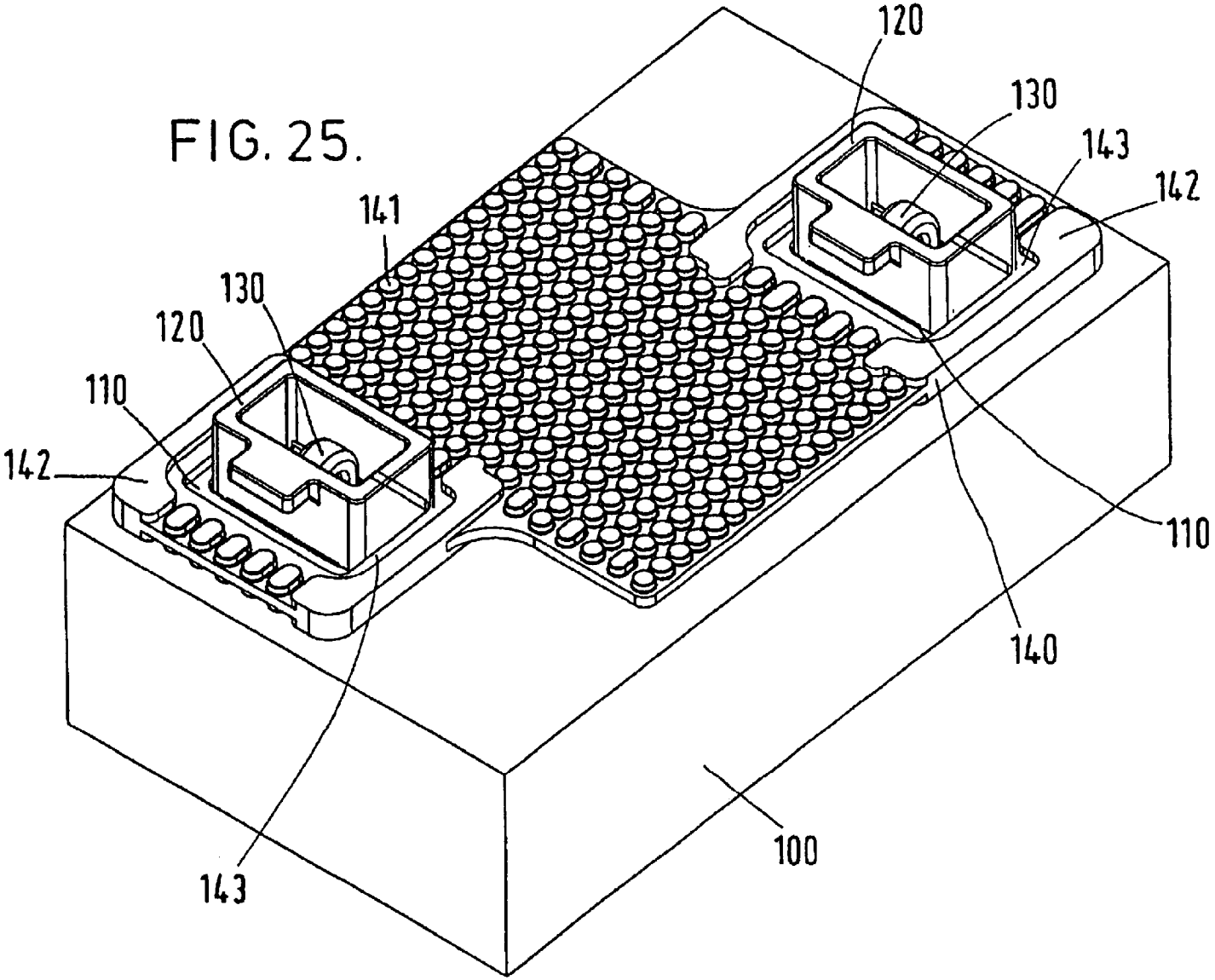
FIG. 25 shows a perspective view of parts of the railway sleeper of FIGS. 17 and 18 together with the second, third and a fourth component of the assembly of FIG. 16.

FIG. 25 shows the cushioning pad 140 in more detail. The cushioning pad 140 has a substantially rectangular central portion 141 formed with studs. At opposite corners of the rectangular studded portion 141 the pad 140 has locating regions 142 formed with respective holes 143 for receiving the post members 120 respectively.

The baseplate 150 shown in FIG. 16 has the same outline as the cushioning pad 140. Post members 120 project into holes 153 respectively provided in the baseplate 150, each hole 153 having a rebate 154 for receiving the corresponding tab 121 of the post member 120 when the baseplate 150 is located in its operative position. The shoulders 152 are designed to receive FASTCLIP™ rail clips as in the first embodiment. The holes 153 may be covered with respective cover members (not shown), as in the first embodiment.

A fifth railway baseplate assembly embodying the present invention will now be described with reference to FIGS. 26 to 29. The fifth embodiment is similar in some respects to the fourth embodiment, in that the lower baseplate of the first embodiment is omitted, but unlike the fourth embodiment the fifth embodiment is not height-adjustable.

Figure 26:
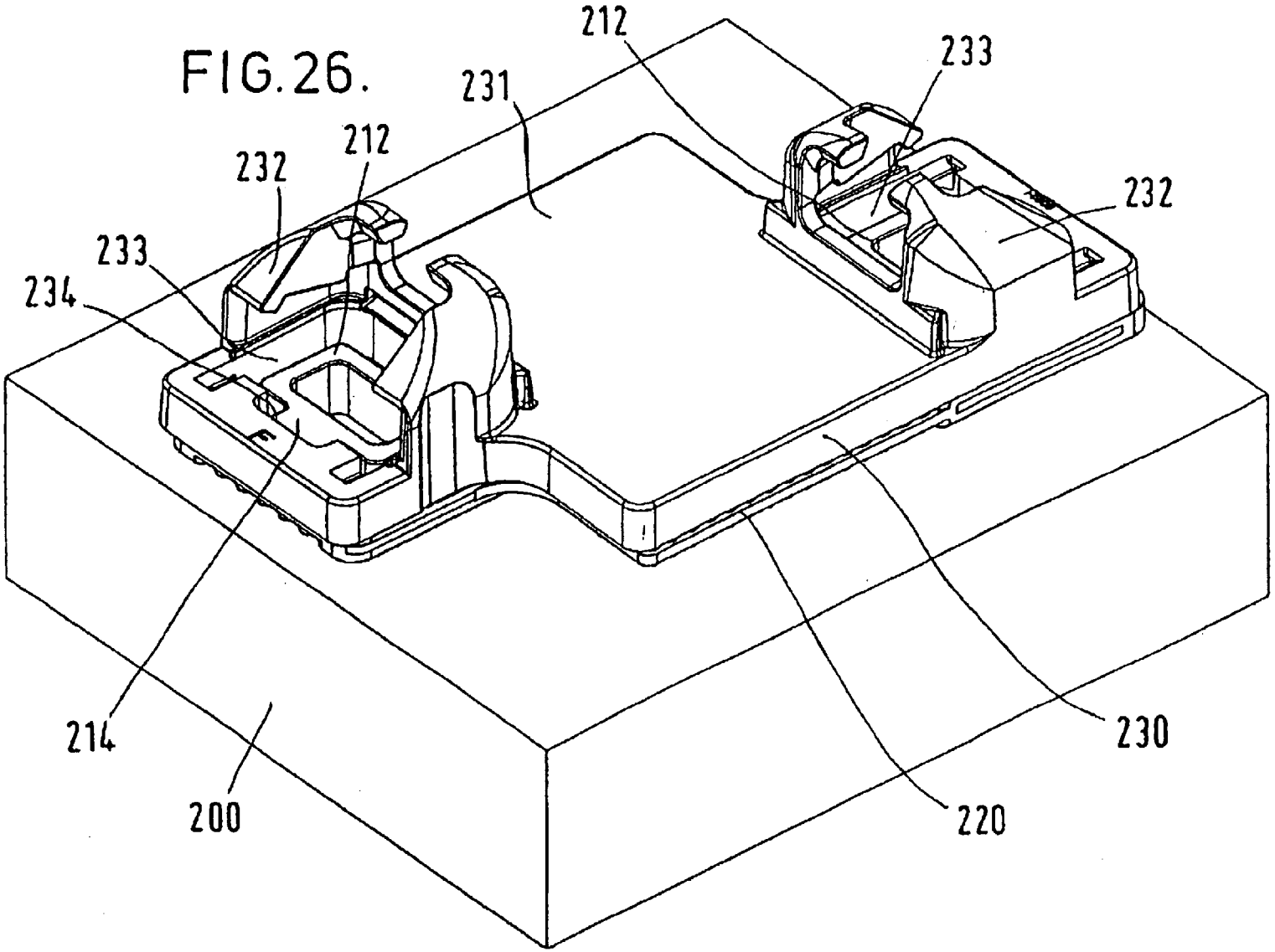
FIG. 26 shows a perspective view of a fifth railway baseplate assembly embodying the present invention.
Figure 27:
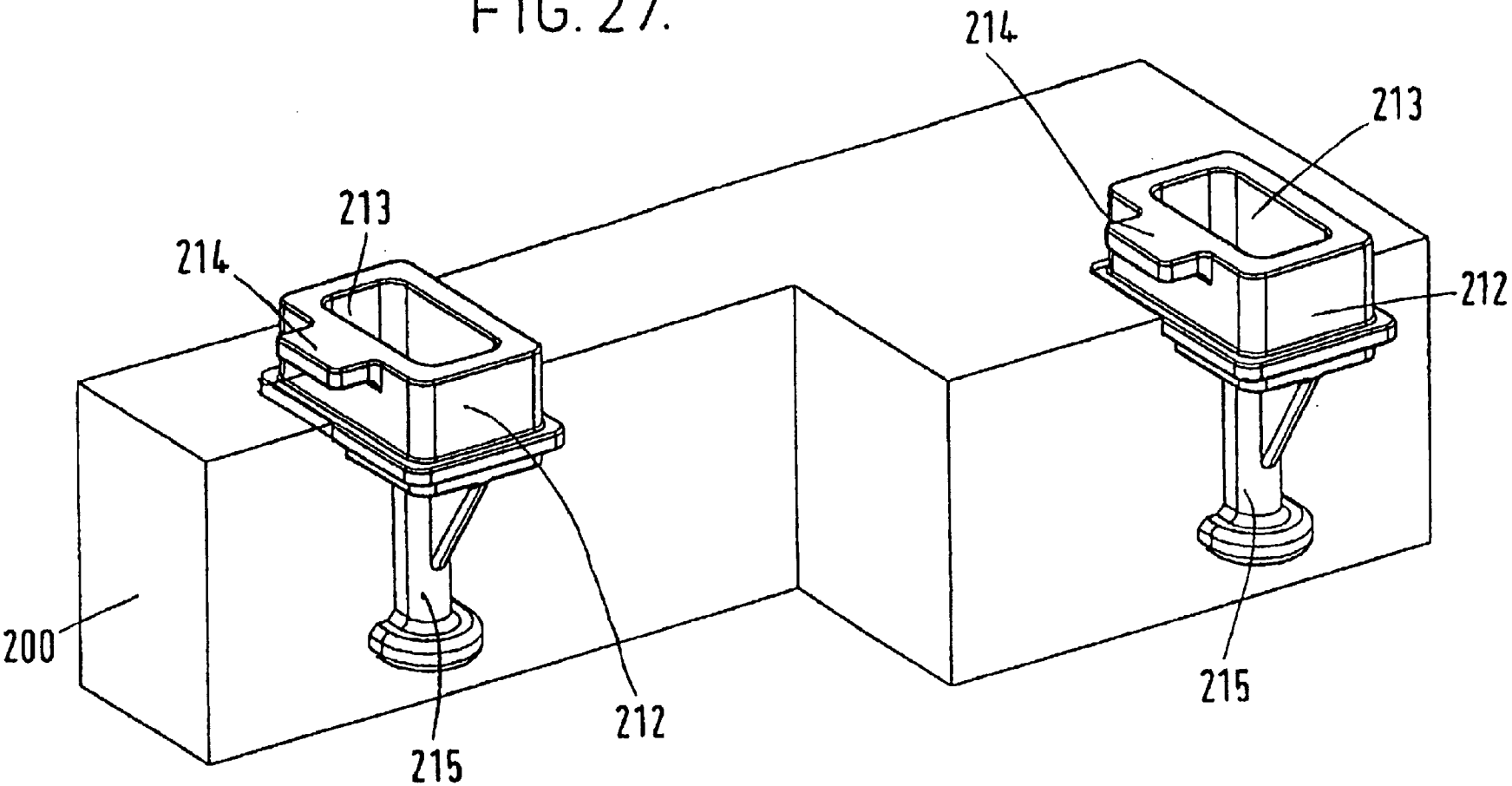
FIG. 27 shows a partially cut-away view of part of a railway sleeper for use in the railway baseplate assembly of FIG. 26, which sleeper incorporates a first component of the said assembly.

FIG. 26 shows the fifth railway baseplate assembly installed on part of a concrete railway sleeper 200. This railway baseplate assembly comprises a baseplate 230 having a central rail seat area 231 for receiving a rail pad (not shown) and rail (also not shown). On either side of the rail seat area 231 are respective shoulders 232 for receiving rail fastening clips (not shown) for holding the rail down to the baseplate 230 and also for locating sidepost insulators (not shown). Between the underside of the baseplate 230 and the upper surface of the concrete sleeper 200 is a cushioning pad 220 made of resilient material. The baseplate 230 is secured to the underlying concrete sleeper 200 by means of post members 212 which pass through respective holes 233 in the baseplate 230. As shown in more detail in FIG. 27, each post member 212 has a recess 213 therein, a laterally-extending tab 214 which overlies part of the baseplate 230 and a vertically-extending stem 215 cast directly into the concrete sleeper 200.

Figure 28:
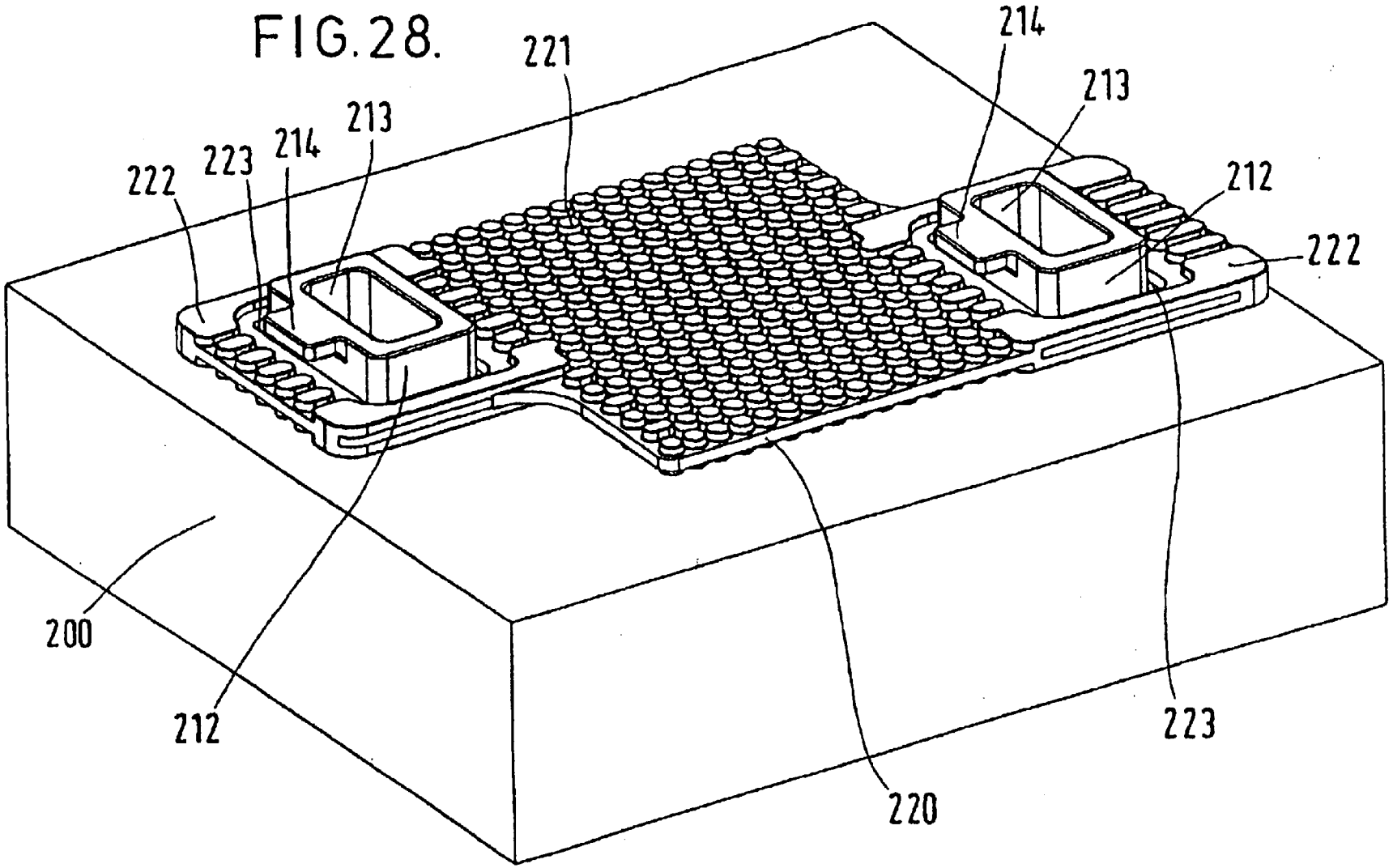
FIG. 28 shows a perspective view of the railway sleeper of FIG. 27 together with a second component of the assembly of FIG. 26.

FIG. 28 shows the cushioning pad 220 in more detail. The cushioning pad 220 has a substantially rectangular central portion 221 formed with studs. At opposite corners of the rectangular studded portion 221 the pad 220 has locating regions 222 formed with respective holes 223 for receiving the post members 212 respectively.

Figure 29:
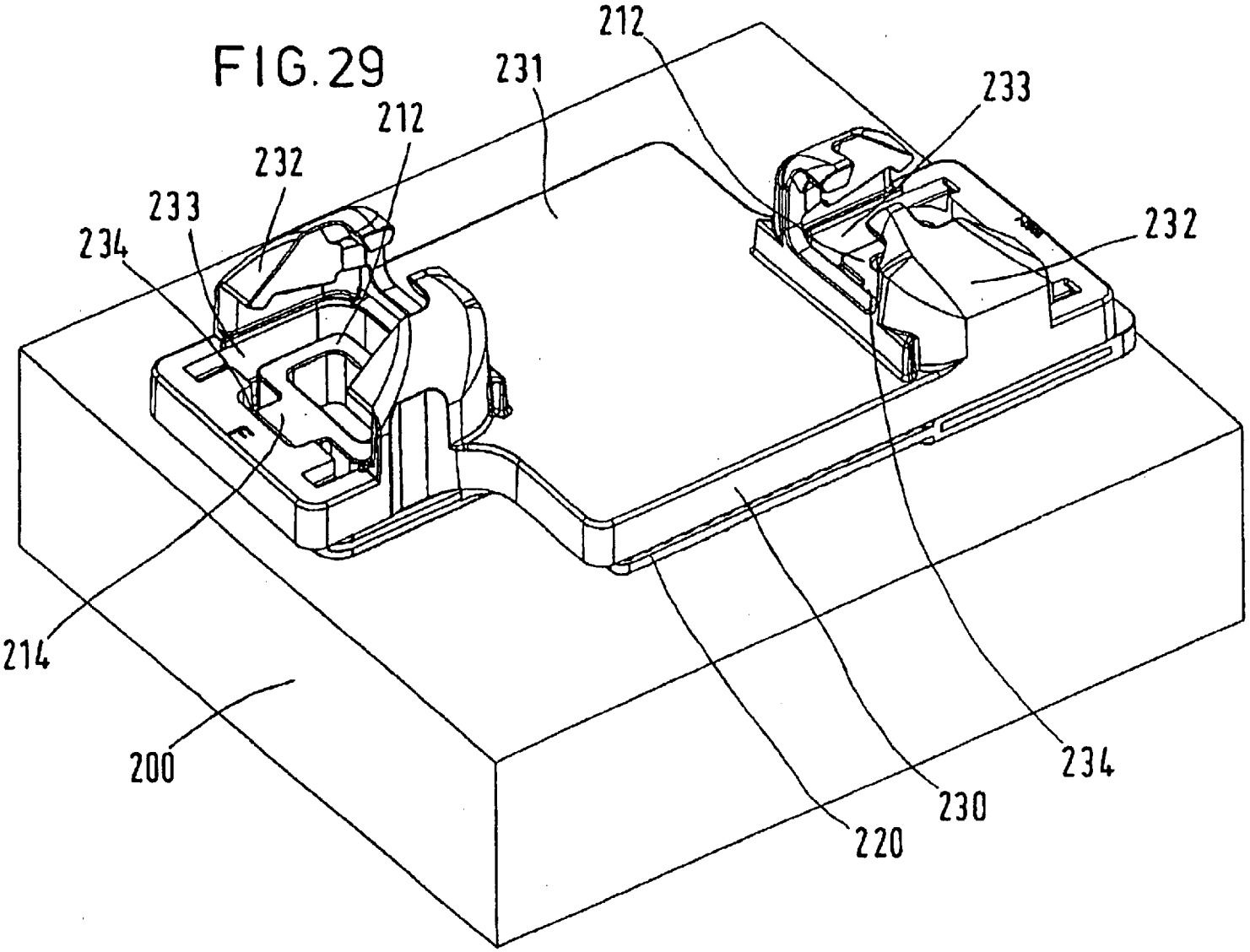
FIG. 29 shows a perspective view of the railway sleeper of FIG. 27 together with the second and a third component of the assembly of FIG. 26 during installation.

The baseplate 230 shown in FIGS. 26 and 29 has the same outline as the cushioning pad 220. Post members 212 project into holes 233 respectively provided in the baseplate 230, each hole 233 having a rebate 234 for receiving the corresponding tab 214 of the post member 212 when the baseplate 230 is slid from its interim position (FIG. 29) to its operative position (FIG. 26). The shoulders 232 are designed to receive FASTCLIP™ rail clips as in the first embodiment. The post members 212 are partially surrounded by respective bushes (not shown) and holes 233 may be covered with respective cover members (not shown), as in the first embodiment.

Thus, the screw-threaded bolt used in the prior art to connect upper and lower baseplates together is replaced in an assembly embodying the present invention by a non-screw-threaded post member extending through a hole in the baseplate in such a way as to engage the baseplate. Moreover, since the means by which the baseplate is secured to the rail foundation are located beneath the rail clips, within the plan view region of the baseplate which also provides for the anchorage of the aforementioned FASTCLIP™ rail fastening clips, the new assembly can be made much smaller than the prior art assembly and still have the advantages provided by using FASTCLIP™ rail fastening clips.

What is claimed is:

1. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein said post member and said baseplate are constructed and arranged such that engagement of said baseplate with said post member can be brought about by movement of said baseplate relative to said post member firstly in a direction substantially perpendicular to the plane of said baseplate and towards said post member to enable said post member to extend through said hole in said baseplate and secondly in a direction substantially parallel to the plane of said baseplate to enable said post member to engage said baseplate.

2. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein said post member is adapted to be fastened, directly or indirectly, to a rail foundation, and said post member, said cushioning pad and said baseplate are constructed and arranged such that said cushioning pad and said baseplate can be brought into engagement with said post member while said post member is fastened to the rail foundation.

3. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise two non-screw-threaded post members, each of which extends through a respective set of holes in said baseplate and said cushioning pad in such a way as to engage said baseplate but not a rail supported by said baseplate.

4. An assembly as claimed in claim 3, wherein two shoulders are provided on an upper surface of said baseplate, said shoulders being configured to enable respective rail fastening clips to be installed in and retained on said shoulders, each of said holes in said baseplate being located adjacent to a respective one of said shoulders such that the rail fastening clips, when installed in said shoulders, at least partially overlie said holes.

5. An assembly as claimed in claim 4, wherein said shoulders are formed integrally with said baseplate.

6. An assembly as claimed in claim 4, wherein said rail fastening clips are approximately M-shaped in plan.

7. An assembly as claimed in claim 6, wherein said shoulders have walls for retaining outer legs of said M-shaped rail fastening clips.

8. An assembly as claimed in claim 7, wherein each said cover is provided with a ramp positioned to be engaged by a mid-region of an associated M-shaped rail fastening clip for deflecting said associated rail fastening clip.

9. An assembly as claimed in claim 6, further comprising a respective sidepost insulator located on each said shoulder and arranged to provide electrical insulation between that shoulder and the rail when in use.

10. An assembly as claimed in claim 9, wherein each said sidepost insulator has means for securing that insulator to said baseplate and a portion for overlying the associated cover, thereby to prevent unintentional disengagement of that cover from said baseplate.

11. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein the or each said post member is provided with a laterally-extending tab adapted to engage with a corresponding ledge provided in said baseplate.

12. An assembly as claimed in claim 11, wherein said securing means comprise two post members, and said tab of one of said post members extends towards a central region of said baseplate and said tab of the other of said post members extends away from said central region of said baseplate.

13. An assembly as claimed in claim 12, wherein said underlying rail foundation comprises a concrete railway sleeper provided with two post housings for said two post members.

14. An assembly as claimed in claim 13, wherein each said post housing is shaped so as to accommodate an associated one of said post members, each said post housing having means for engaging said associated post member.

15. An assembly as claimed in claim 14, wherein each said post member engaging means comprises serrations, provided on an interior portion of an associated said post housing, for engaging corresponding serrations provided on an exterior portion of that post member.

16. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein the or each said post member is hollow and substantially rectangular in outline.

17. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein the or each said post member extends into an associated post housing provided in said rail foundation.

18. An assembly as claimed in claim 17, wherein the or each said post member and the or each said post housing are provided with respective sets of interlockable serrations, whereby the height of the or each said post member within its associated post housing can be adjusted.

19. An assembly as claimed in claim 18, wherein the or each said post member is retained at a desired height within its associated post housing by means of a respective wedge member inserted between that post member and said associated post housing.

20. An assembly as claimed in claim 19, wherein the or each said post member is hollow so as to accommodate said respective wedge member and has a tapered internal surface opposite to a portion of a wall of that post member open to said associated post housing, whereby each said wedge member may bear against said tapered internal surface of the associated said post member and said associated post housing.

21. An assembly as claimed in claim 18, further comprising a shim adapted to be placed between said baseplate and the underlying rail foundation so as to support said baseplate at a desired height above the rail foundation.

22. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, the assembly further comprising a lower baseplate adapted to be located beneath said first-mentioned baseplate, the or each said post member projecting upwardly from said lower baseplate, and said lower baseplate being attached to the underlying rail foundation when the assembly is in use.

23. An assembly as claimed in claim 22, wherein the or each said post member is formed integrally with said lower baseplate.

24. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein the or each said post member is directly secured to the underlying rail foundation.

25. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein the or each said post member is at least partially surrounded by a bush provided within the associated hole in said baseplate.

26. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein a respective cover is provided over each of said holes in said baseplate.

27. An assembly as claimed in claim 26, wherein means are provided for locking each of said covers onto said baseplate.

28. A railway baseplate assembly for supporting a railway rail, which assembly comprises a baseplate, a cushioning pad for lying beneath the baseplate, and means for securing the baseplate to an underlying rail foundation when the assembly is in use, wherein said securing means comprise at least one non-screw-threaded post member extending, when in use, through corresponding holes provided in said baseplate and said cushioning pad in such a way as to engage said baseplate but not a rail supported by said baseplate, and wherein said cushioning pad has a sufficient number of holes formed therein for receiving the or each respective post member.

* * * * *